United States Patent [19]

Iwama et al.

[11] Patent Number: 5,002,711

[45] Date of Patent: Mar. 26, 1991

[54] METHOD AND APPARATUS FOR SETTING PATTERN FRAME AND PRESS DIE IN INSTANT-RELEASE TYPE MOLDING MACHINE FOR CONCRETE PRODUCT

[75] Inventors: Eiji Iwama, Koshigaya; Takateru Hatanaka, Kasukabe, both of Japan

[73] Assignee: Chiyoda Technical & Industrial Company Ltd., Tokyo, Japan

[21] Appl. No.: 751,220

[22] Filed: Jul. 2, 1985

[30] Foreign Application Priority Data

Jul. 11, 1984 [JP] Japan ..... 59-142237
Sep. 10, 1984 [JP] Japan ..... 59-188162

[51] Int. Cl.[5] ..... B28B 3/00

[52] U.S. Cl. ..... 264/71; 100/918; 264/333; 425/186; 425/193; 425/195; 425/413; 425/421

[58] Field of Search ..... 425/18, 193, 195, 413, 425/421, 253, 255, 452, 186; 264/333, 71; 100/918

[56] References Cited

U.S. PATENT DOCUMENTS

| | | | |
|---|---|---|---|
| 2,856,668 | 10/1958 | Cravens | 425/195 |
| 3,149,392 | 9/1964 | Ripley | 425/439 |
| 3,274,659 | 9/1966 | Baker | 425/253 |
| 3,277,551 | 10/1966 | Sekiguchi | 425/253 |
| 3,422,661 | 1/1969 | Blackhurst | 100/918 |
| 3,425,363 | 2/1969 | Carbon | 425/195 |
| 3,455,141 | 7/1969 | Bracco et al. | 100/918 |
| 3,500,514 | 3/1970 | Ruegsegger | 425/193 |
| 3,593,381 | 7/1971 | Ogle | 425/195 |
| 3,799,721 | 3/1974 | Howard | 425/195 |
| 3,831,427 | 8/1974 | Lee | 100/918 |
| 4,249,358 | 2/1981 | Thieffry | 425/195 |
| 4,274,824 | 6/1981 | Mullins | 425/413 |
| 4,412,800 | 11/1983 | Dorsey | 425/195 |
| 4,445,839 | 5/1984 | Crane | 425/432 |
| 4,500,275 | 2/1985 | Ruhl | 425/195 |
| 4,555,228 | 11/1985 | Nishiike et al. | 425/185 |
| 4,631,015 | 12/1986 | Shigeo et al. | 425/195 |
| 4,718,339 | 1/1988 | Wymann | 100/918 |
| 4,773,839 | 9/1988 | Case et al. | 100/918 |
| 4,795,334 | 1/1989 | Kitahara | 425/195 |

FOREIGN PATENT DOCUMENTS

| | | | |
|---|---|---|---|
| 0169678 | 1/1986 | European Pat. Off. | 425/195 |

*Primary Examiner*—James C. Housel
*Attorney, Agent, or Firm*—Schwartz & Weinrieb

[57] ABSTRACT

An instant-release type concrete molding machine manufactures a concrete product by interposing unitable attachment devices between a press die and a press, placing an attachment unit of a pattern frame within a molding region, introducing the pattern frame and the press die into the molding region in alignment with the press, moving the press and the press die toward each other and uniting them by the aforementioned attachment devices, and fixing the pattern frame by the attachment unit within the molding region.

20 Claims, 13 Drawing Sheets

4
M1
M1
12
39'
13
1
4'
39
6
6'
5
3
3'
57'
58
15'
15
2
60
54
60
31'
31
30
56
55
64

METHOD AND APPARATUS FOR SETTING PATTERN FRAME AND PRESS DIE IN INSTANT-RELEASE TYPE MOLDING MACHINE FOR CONCRETE PRODUCT

BACKGROUND OF THE INVENTION

1. Field of the Invention

This invention relates to a method and apparatus for setting in place within an instant-release type molding machine for a concrete product a pattern frame for molding a product and a press die for compression molding concrete material fed in the cavity of the pattern frame.

2. Description of the Prior Art

In the instant-release type concrete molding machine, the steps of filling a pattern frame with stiff concrete, molding the concrete, and immediately releasing the molded concrete product from the pattern frame are repeated. Unlike the cast concrete molding machine, this instant-release type molding machine enjoys the advantage that it does not require any provision for alternately removing a pattern frame filled with stiff concrete and inserting an empty pattern frame. The instant-release type molding machine by nature entails the necessity for changing pattern frames whenever a prescribed number of concrete products have been molded in a pattern frame of a given shape and other concrete products are to be molded in a pattern frame of a different shape. This change of pattern frames has heretofore been effected manually with the aid of a crane. Especially, the bolts and nuts for fixing many shock-absorbing members in place within the machine have been fastened and unfastened manually. This work is complicated and consumes much time. The operation of the molding machine has to be suspended while this work is in progress. This fact has significantly impaired the productivity of the instant-release type molding machine.

OBJECT OF THE INVENTION

The principal object of this invention is to provide an apparatus capable of readily permitting attachment and detachment of a pattern frame and a press die and retaining them as positioned accurately in an instant-release type concrete product molding machine and a method for setting the pattern frame and the press die in place within the instant-release type concrete product molding machine.

SUMMARY OF THE INVENTION

This invention is directed to detachable means of attachment between a press die and a press, and means for attachment of a pattern frame in a molding region of an instant-release type concrete product molding machine, and the machine provided with these means is adapted to introduce the pattern frame and the press die into the molding region opposed upwardly to the press, bring the press and the press die toward each other and into fast mutual union by drive means and secure the pattern frame in place by a retaining means disposed in the molding region.

In the instant-release type concrete product molding machine adopting this invention, the press die and the pattern frame can be accurately and easily set in place because the press die is brought into a state assembled on the pattern frame and attached in that state to the press, and the press die and the pattern frame and consequently fixedly retained inside the molding region by causing the press die as correctly positioned relative to the cavity of the pattern frame to be introduced into the molding region or by introducing the pattern frame and the press die independently into the molding region and positioning them correctly within the molding region.

After molded concrete products have been produced in the prescribed number, the press die fastened to the press and the pattern frame fastened in the molding region are released and removed, and a press die and a pattern frame for the next batch of concrete products are inserted and fastened respectively to the press and in the molding region.

BRIEF DESCRIPTION OF THE DRAWINGS

The other objects and characteristic features of this invention will become apparent from the further disclosure to be given hereinbelow with reference to the accompanying drawings wherein.

DESCRIPTION OF PREFERRED EMBODIMENTS

Figure 1:
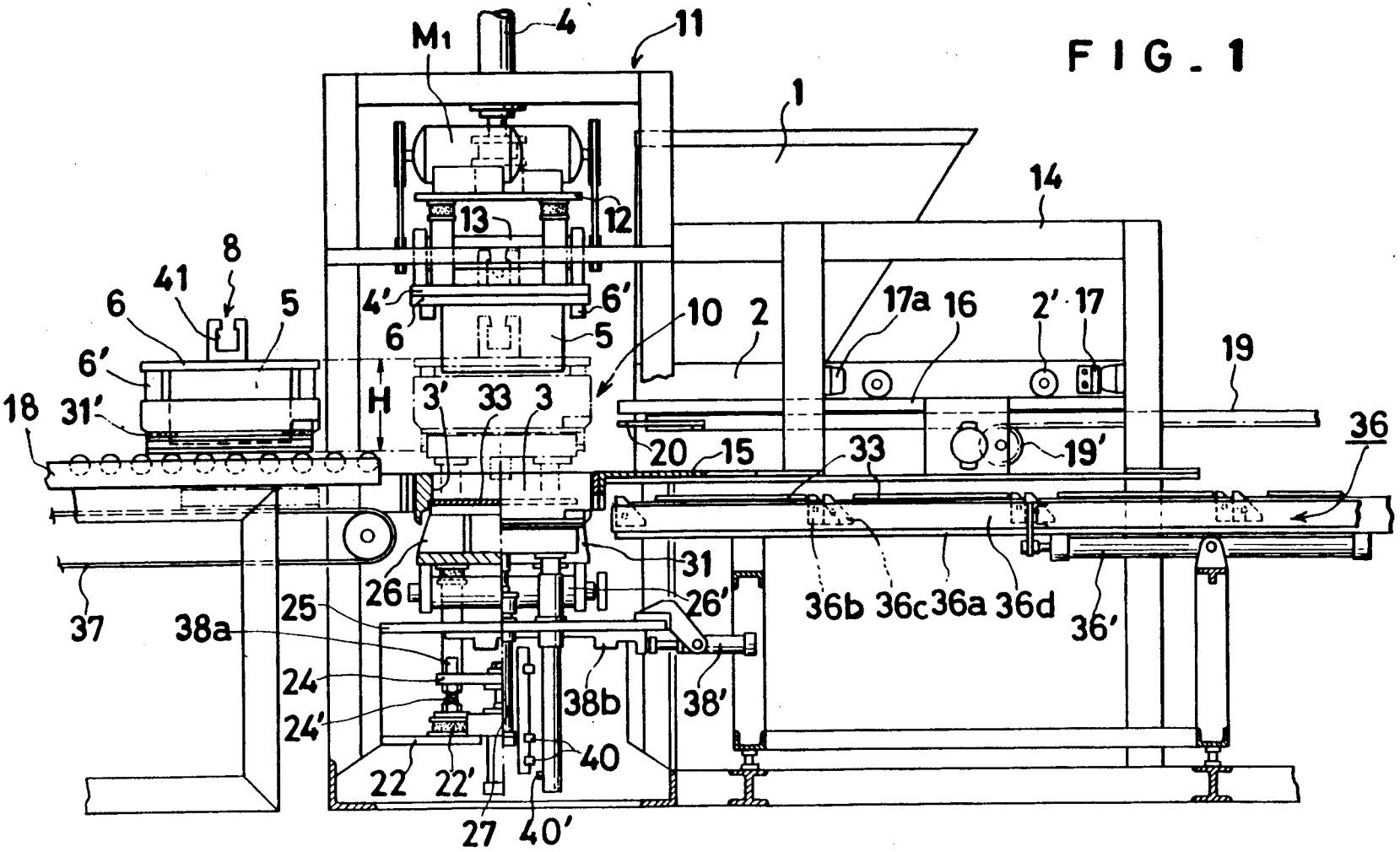
FIG. 1 is a partially sectioned side view of an instant-release type concrete product molding machine adopting one embodiment of the present invention.

In the drawings illustrating various embodiments of this invention, 1 denotes a hopper, 2 a material feeding box, 3 a pattern frame, 3' a cavity of the pattern frame, 4 a piston cylinder serving as a press, 4' a fitting plate for a press die, disposed at the lower end of the press, 5 a press die, 6 a base plate having the press die 5 fastened on the lower side thereof, 7 and 8 means disposed on the fitting plate 41 and the base plate 6 and adapted jointly to attach and detach the press die 5, 9 a drive means for the means of attachment, and 10 a molding region of the molding machine.

The first embodiment of this invention is illustrated in FIGS. 1 through 10. A motor base 12 is horizontally disposed and fastened through a shock-absorbing rubber member to the piston end of the press 4 having the piston thereof attached thereto as extending downwardly from the center of on the upper end of a longitudinal frame 11. The fitting plate 4' is horizontally disposed and suspended through a shock-absorbing rubber member from the lower side of the motor base 12. A vibrator 13 mounted on the fitting plate 4' and adapted to vibrate the press die 5 is driven by a motor $M_1$ on the motor base 12. The hopper 1 is supported on a hopper frame 14 juxtaposed to the frame 11. The material supply box 2 is longitudinally reciprocated on a horizontal deck 15 which is disposed as extended from the hopper frame 14 into the interior of the frame 11. The material supply box 2 receives stiff concrete material at its most retracted position directly below the hopper and dumps the concrete material into the cavity 3' of the pattern frame 3 at its most advanced position in the molding region 10 inside the frame 11. By 16 is denoted each of the laterally opposed rails for supporting wheels 2' of the material supply box 2 and guiding the longitudinal reciprocation thereof. Stoppers 17 project from the lateral sides of the material supply box, and stop pieces **17*a* and 17*b* serve to block the aforementioned stoppers and determine the most advanced position and the most retracted position of the material supply box 2. By 2*a* is denoted a piston cylinder for imparting a reciprocating motion to the material supply box 2. The base plate 6 of the press die 5 is provided at each of the four corners thereof with a downwardly protruding pin 6'. The lower ends of the pins 6' are held in contact with the upper side of the pattern frame 3**.

The press die 5 and the pattern frame 3 are independently brought into the molding region 10 and are properly positioned and secured therein by the use of the aforementioned pins 6' or some other suitable jigs.

Generally, the press die 5 and the pattern frame 3 constitute an operative pair. It is, therefore, convenient for the pattern frame 3 and the press die 5 to be joined in an assembled state and brought in that state into the molding region 10 by a suitable means of conveyance. The most convenient and reliable means of positioning the press die 5 relative to the cavity of the pattern frame 3 and assembling it on the pattern frame 3 is to fit the lower part of the press die 5 into the cavity 3'.

After the press die 5 has been fitted into the cavity of the pattern frame as described above, the assembled pair is first moved in the direction of the frame by a means of conveyance 18.

Figure 2:
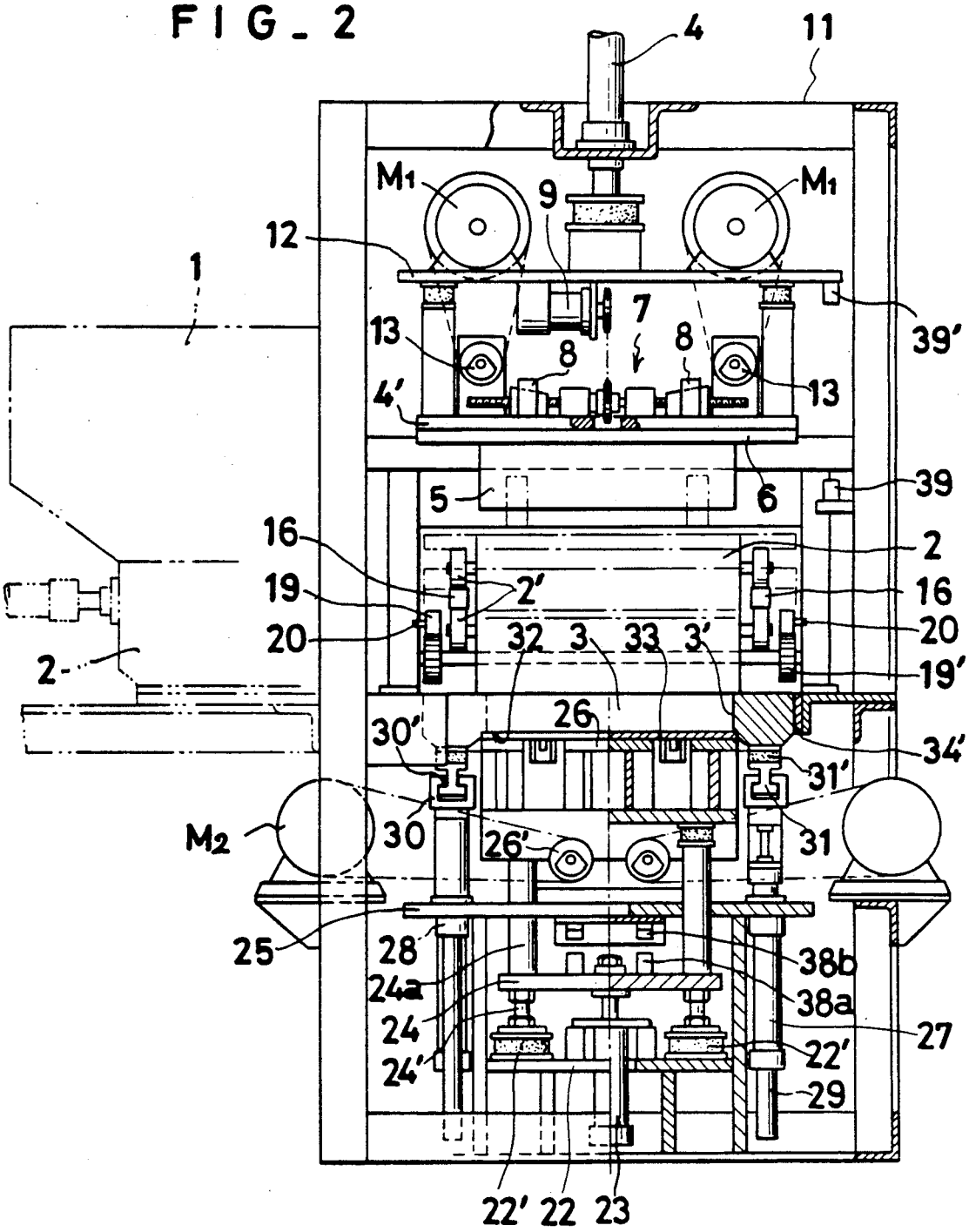
FIG. 2 is a partially sectioned front view of the molding machine of FIG. 1.
Figure 3:
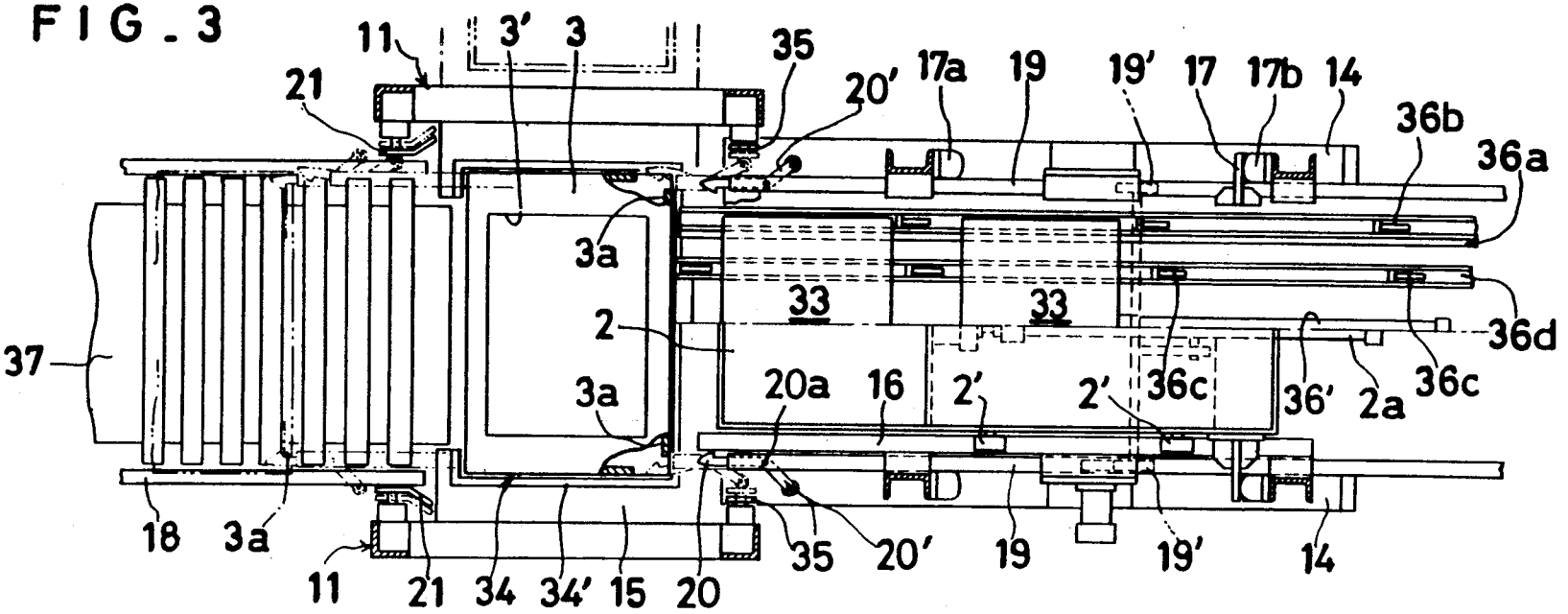
FIG. 3 is a partially sectioned plan view of the molding machine of FIG. 1.
Figure 6:
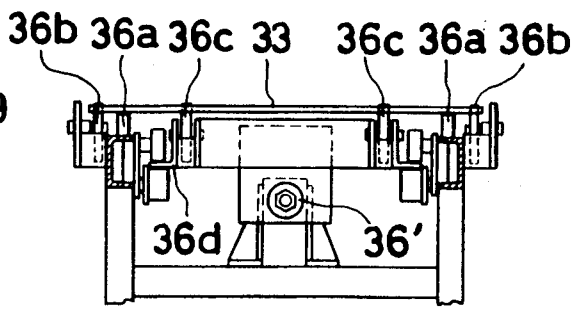
FIG. 6 is a front view of a pallet feeder of the molding machine.
Figure 5:
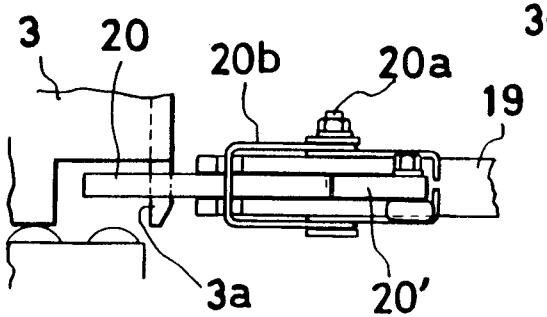
FIG. 5 is a side view of the push-pull rod of FIG. 4.
Figure 4:
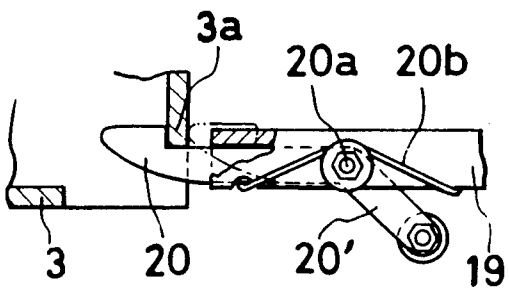
FIG. 4 is an enlarged plan view of the essential part of a push-pull rod for the molding machine of FIG. 1.
Figure 11:
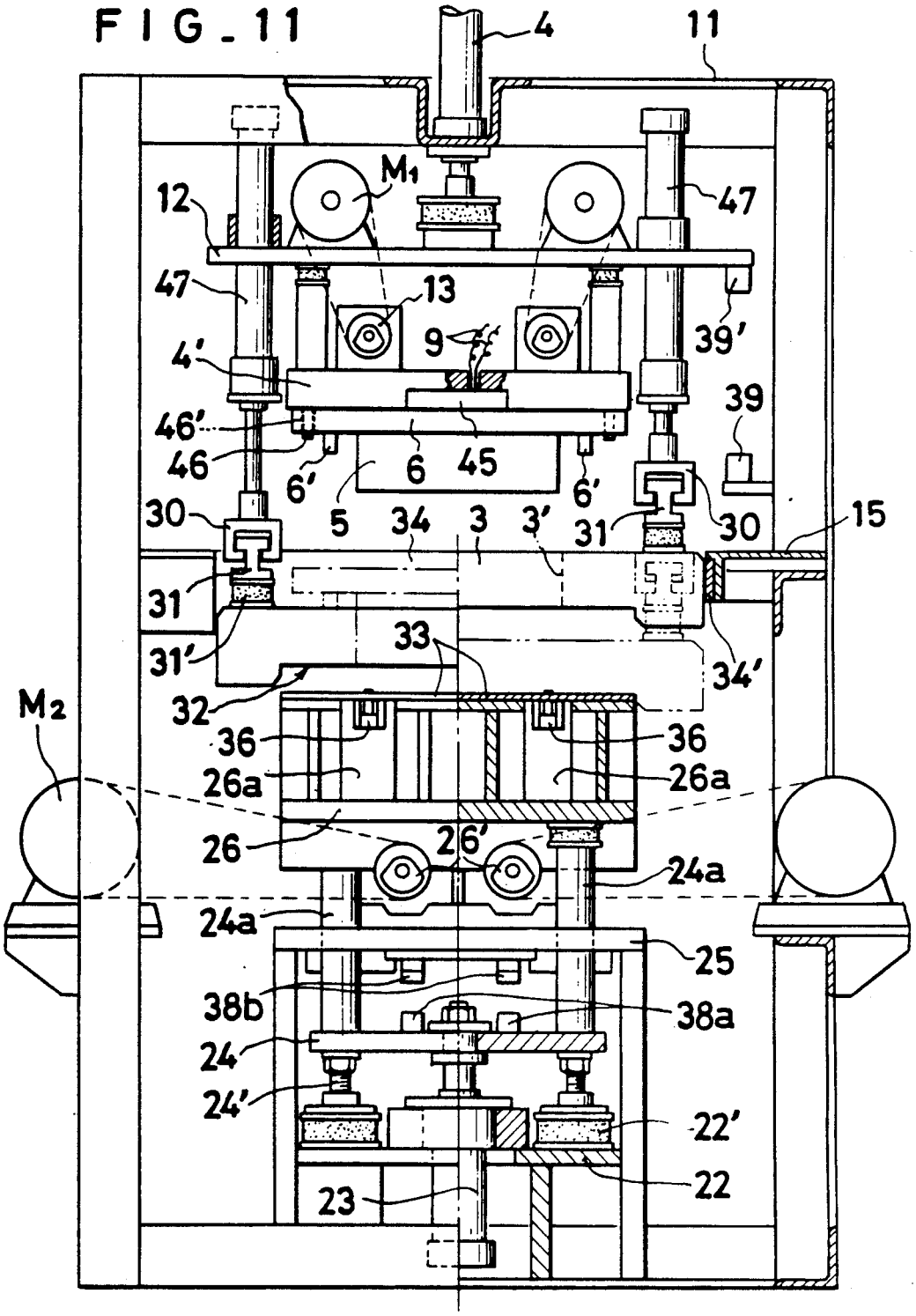
FIG. 11 is a schematic front view of a molding machine, partly in cross section, adopting the second embodiment of the present invention.
Figure 16:
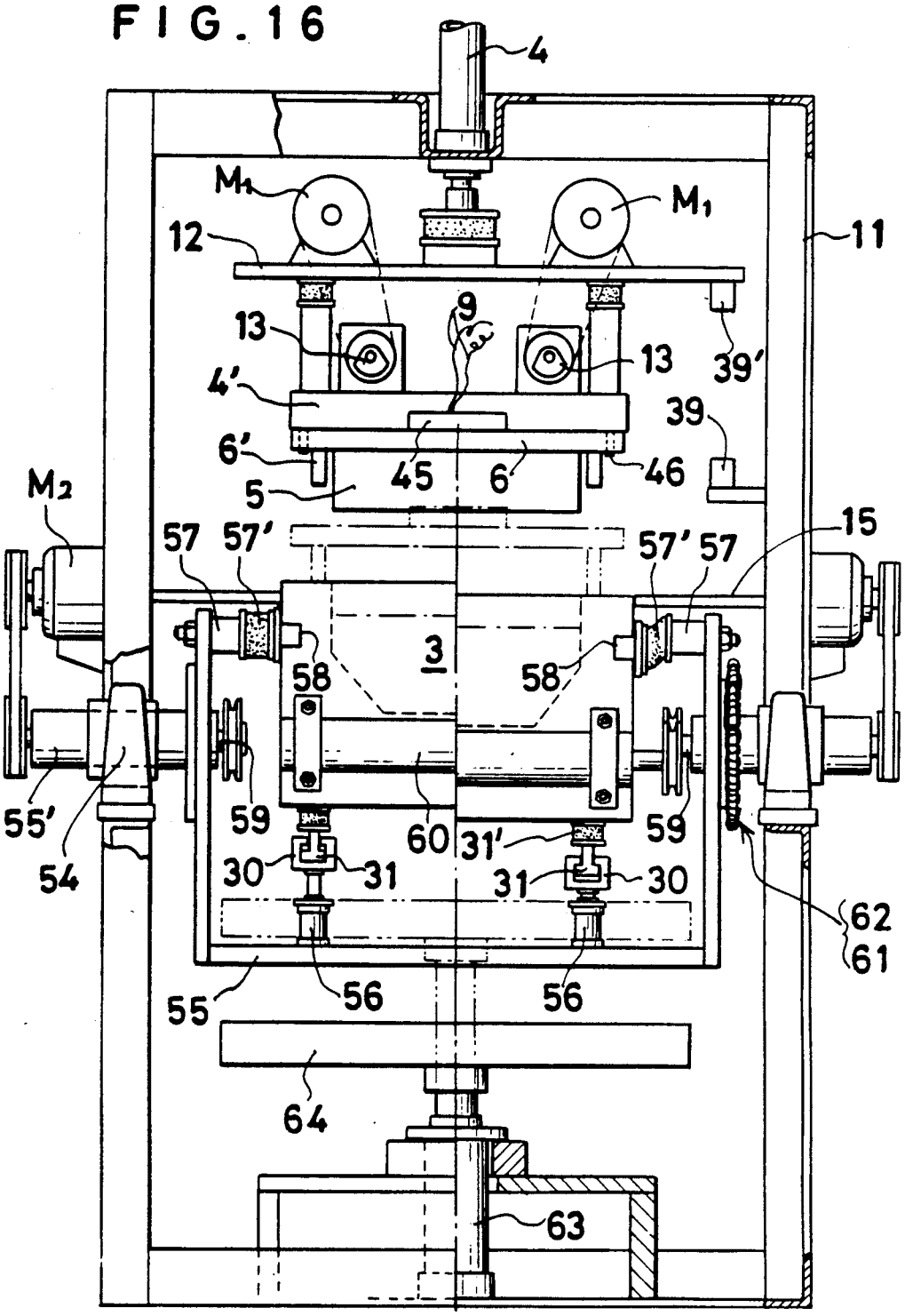
FIG. 16 is a front view of a molding machine, partly in cross section, adopting the third embodiment of this invention.
Figure 17:
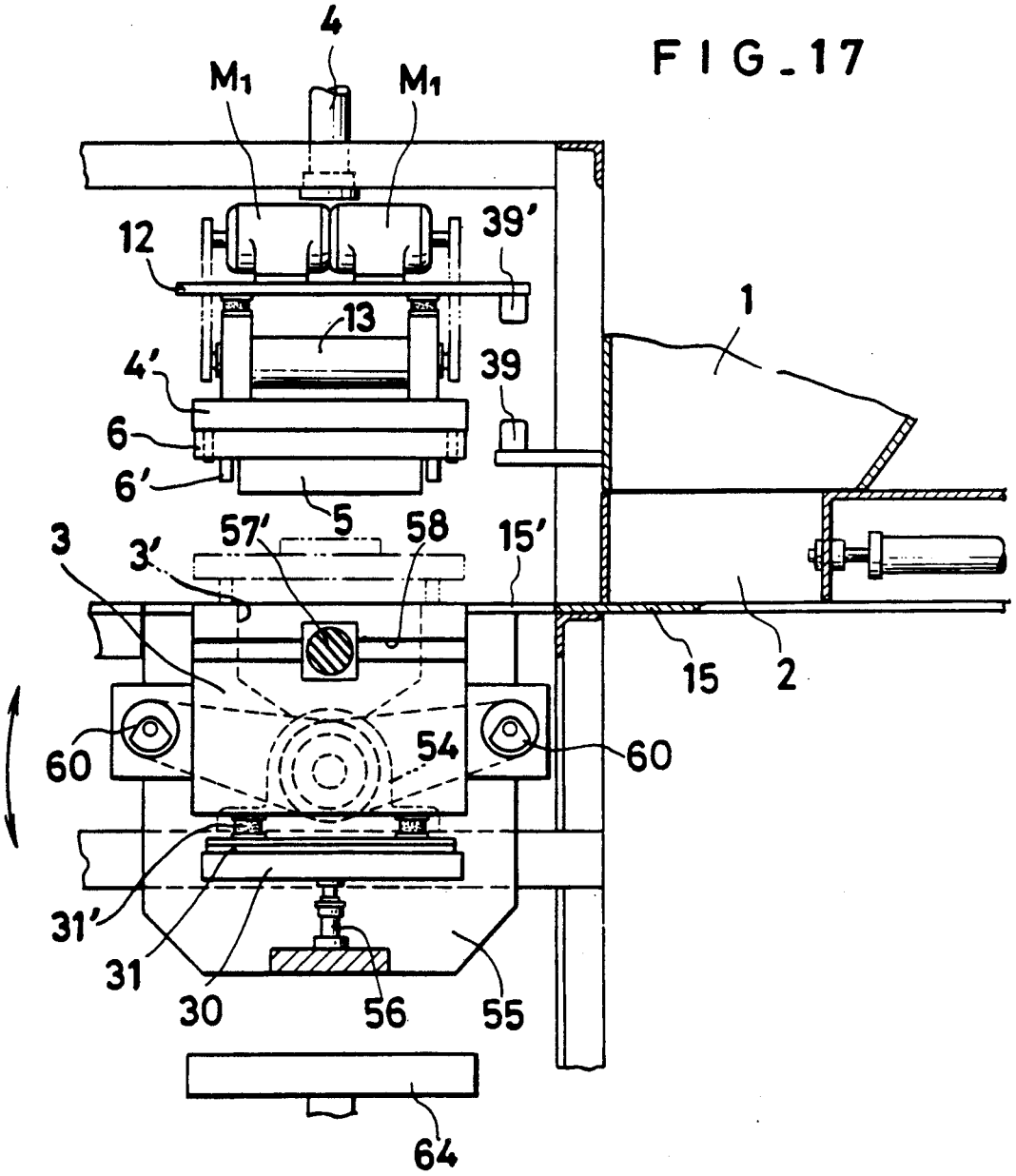
FIG. 17 is an enlarged side view of an essential part of the molding machine of FIG. 16.

In the first embodiment illustrated in FIGS. 1 through 10, the second embodiment in FIG. 11, and the third embodiment in FIGS. 16 and 17, the assembled pair is brought into the front side of the frame 11 by a roller-driven type roller conveyor 18 shown in FIG. 1 and FIG. 3. A pair of laterally opposed push-pull rods 19 are provided to be longitudinally reciprocated along the aforementioned pair of rails 16 laid on the hopper frame 14 for the purpose of moving the pattern frame 3 further into the molding region 10 within the frame 11 and moving the pattern frame out of the molding region 10 onto the conveyance means 18. To the leading end of each of the rods 19, a claw piece 20 is rotatably attached (FIGS. 3 through 5). Each rod 19 is provided on the lower side thereof with a rack and is longitudinally reciprocated by the rack being meshed with a toothed wheel 19' rotated by a hydraulic motor. The claw piece 20 is in the shape of a bell crank having the middle part thereof pivotally fastened to the leading end of the rod. The claw 20 is urged into a closed state by one end of a spring **20*b* helically wound around a pivotal shaft 20*a* thereof with the other end thereof hooked on the rod 19. In this closed state, the claw piece 20 has the latter half parts thereof projecting out from the lateral sides of the rod 19, led in through the notches in the rear parts of the lateral sides of the pattern frame 3, and allowed to grasp the lateral edges of a rear end plate 3*a* of the pattern frame 3 so as to pull the pattern frame 3 into the molding frame 11 from above the means of conveyance 18 (solid line). Otherwise, the lateral edges of the rear end plate of the pattern frame 3 may be pushed from behind by the leading ends of the laterally opposed claws 20 or the front ends of the laterally opposite rods 19 so as to move the pattern frame 3 from within the frame 11 onto the means of conveyance 18** (broken line).

To effect the introduction of the pattern frame 3, the push-pull rods 19 are advanced to the fullest possible extent until the claw pieces 20 reach the upper side of the front end part of the means of conveyance 18. A pair of guides 21 capable of reciprocating the piston cylinder oppose each other across the means of conveyance 18 in the front end part thereof (FIG. 3). While the guides are in their advanced state, the claw pieces 20 are moved away from each other as the rear ends 20' thereof protruding from the lateral sides of the rods 19 are pushed by the guides 21 and the claw pieces 20 are moved toward each other and allowed to take hold of the lateral edges of the rear end plate **3*a* of the pattern frame 3 as the rear ends 20' pass the guides 21 (at which time the rods 19 assume their most advanced position). As a result, the introduction is attained by pulling in the guides 21 and moving the push-pull rods 19 backwardly. In this case, the position at which the means of conveyance 18 transfers the pattern frame 3 to the front side of the molding frame 11 is where the claw pieces 20 are allowed to grasp the rear end plate 3*a* of the pattern frame 3 as described above. The arrival of the pattern frame 3 at this point is detected by a limit switch (not shown), with the result that the operation of the means of conveyance 18** is discontinued.

In the first embodiment, a cylinder 23 having a piston thereof directed upwardly from a stationary base plate 22 is fixed at the lower central area of the molding region 10 of the frame 11 and this piston is provided with a horizontally fastened elevating plate 24. The elevating plate 24 is provided at each of the four corners thereof with a downwardly extending leg 24'. When the piston is lowered, therefore, the lower ends of the legs 24' come into contact with the shock-absorbing rubber member 22' on the stationary base plate 22. Above the elevating plate 24, there is disposed a horizontal table 25 fastened to the frame 11. Four pillars 24a erected upright one each at the four corners on the upper side of the elevating plate 24 are allowed to penetrate the table 25 vertically. On the upper ends of the four pillars 24a, a vibrating base 26 provided with a vibrator 26' used for vibrating the pattern frame 3 is set in place through shock-absorbing rubber members. When the piston of the cylinder 23 is extended upwardly, therefore, the elevating plate 24 and the vibrating base 26 are elevated as guided by the table 25. The vibrator 26' is driven by motors $M_2$ which are fixed on the frame 11. Cylinders 27 having pistons thereof extending upwardly are fixed one each at the centers of the opposite lateral parts of the table 25 so as to extend therethrough, and guide tubes 28 for cylinders 27 are fixedly disposed within table 25. On the upper end of the piston on the lefthand side and the upper ends of elevating rods 29 adapted to penetrate the guide tubes 28 and on the upper end of the piston on the righthand side and the upper ends of elevating rods 29 adapted to penetrate the guide tubes 28, a pair of laterally opposed rails 30 are attached as means of transferring the pattern frame 3 to and from the means of conveyance 18 and for fixedly retaining the pattern frame 3 within the molding region 10. The rails 30 are only required to be adapted so as to be hung vertically from engaging parts 31 disposed along the laterally opposite edges on the lower side of the pattern frame 3. In the present embodiment, since the engaging parts 31 are downwardly projecting pieces of a cross section having the shape of an inverted "T", the rails 30 have a cross section containing a groove on the upper side. The rails 30 are given a cross section of the shape of three sides of a square when the engaging parts 31 have a cross section of the letter "L" projecting downwardly. They are given a cross section of the shape of the letter "T" when the engaging parts 31 are grooves of a cross section of the letter "T" formed along the laterally opposite edges of the pattern frame 3. In short, the rails 30 are formed in a cross section which has a male to female relationship with the cross section of the engaging parts 31 of the pattern frame. Then, the engaging parts 31 are attached through shock-absorbing rubber members 31' to the pattern frame 3 3. Otherwise, the rails 30 are attached through shock-absorbing rubber members to the upper ends of the pistons of the cylinders 27 and to the upper ends of the elevating rods 29 disposed before and after the cylinders 27.

The pattern frame 3 is possessed of an upward depression 32 of the shape of a picture frame on the lower side of the molding region 10 between the pair of laterally opposed engaging parts 31, and the lower end of the vertical through cavity 3' of a prescribed shape opens into the upper side of the aforementioned depression 32. This depression 32 snugly admits the upper end part of the vibrating base 26 through a flat bottom plate (plane pallet) 33 which will be more fully described afterward. Consequently, the vibrating base 26, the pattern frame 3, and the press die 5 are correctly aligned in their respective molding positions. Then, the press die 5 is joined to the press 4 by lowering the press 4 and putting the attaching means 7, 8 into union.

The horizontal deck 15 on which the material supply box 2 is longitudinally reciprocated has a hole, suitable for insertion of the pattern frame 3, bored in the portion thereof disposed within the frame 11. To the inside of this hole, plates having shock-absorbing pieces 34' such as of rubber applied on the inner sides thereof are attached so as to extend downwardly to give rise to an inserting part 34 defined by the shock-absorbing pieces 34' and adapted to encircle the pattern frame 3 (FIG. 3). This inserting part 34 may encircle all the vertical sides of the pattern frame. As is plain from FIG. 3, this thorough encircling is not always required. The inserting part 34 may expose part of the pattern frame. The portion of the inserting part 34 which exposes the pattern frame 3 may be used for the removal of the molded product as will be described afterward. The centers of the fitting plate 4', the vibrating base 26, and the inserting part 34 are exactly aligned in the vertical direction.

Now, the work of changing pattern frames and press dies and the work of molding of concrete products will be described in outline below based mainly on the construction so far described. In the embodiment to be described below, the press die 5 is adapted to be inserted into the cavity of the pattern frame 3. In setting the pattern frame 3 in place within the frame 11, the piston of the cylinder 27 is extended upwardly. As a result, the laterally opposed rails 30 are lifted through the interior of the inserting part 34 and past the upper surface of the deck 15 and brought to a stop at a level flush with the laterally opposed engaging parts 31 on the lower side of the pattern frame 3 brought in as mounted on the means of conveyance 18.

Then the laterally opposed rods 19 are moved to the most advanced position as described above so that the claw pieces 20 at the leading ends thereof will grasp the laterally opposed edges of the rear end plates 3a of the pattern frame 3 and subsequently, the rods 19 are moved rearwardly. As a result, the pattern frame 3 and the press die 5 assembled integrally thereon are jointly moved rearwardly and the engaging parts 31 are slid off conveyance 18 so that the rear ends of the engaging parts 31 are engaged with the laterally opposed rails 30, enabling them to be transferred from the means of conveyance 18 to the rails 30. When the pattern frame 3 and the press die 5 arrive in the molding region directly above the inserting part 34, the limit switch detects this arrival and causes momentary suspension of the rearward motion of the laterally opposed rods 19. Then a pusher 35 such as of a piston cylinder is actuated to push the rear end parts of the laterally opposed claw pieces 20 away from each other (FIG. 3), and allow the rods 19 to be moved to the most retracted position.

Then, the pattern frame 3 is provisionally lowered into the inserting part 34 by the pistons of the cylinders 27 and the depression 32 on the lower side of the pattern frame 3 is fitted around the upper end part of the vibrating table 26 to correctly position inside the inserting part 34 the pattern frame 3 and the press die 5 assembled thereon and, thereafter, the pattern frame 3 and the press die 5 are elevated to their formerly introduced position by the pistons of the cylinders 27.

Then, the piston of the press 4 is extended downwardly and the means of attachment 7, 8 disposed separately on the press 4 and the press die 5 are joined to each other by the drive means 9 to effect union of the press die 5 with the press 4. The press die 5 is separated above the pattern frame 3 by raising the piston of the press 4 and the pattern frame 3 is lowered into the inserting part 34 by the pistons of the cylinders 27.

For the pattern frame 3 and the press die 5 to be transferred onto the means of conveyance 18 for the purpose of replacement, the pistons of the cylinders 27 are raised to actuate the laterally opposed rails 31 and push the pattern frame 3 up to the formerly introduced position above the deck 15, the press 4 is lowered to insert the press die 5 into the cavity of the pattern frame 3, and the means of attachment 7, 8 are disconnected by the drive means 9 and, thereafter, the laterally opposed rods 19 are moved forward from the retracted position. As a result, the front ends of the rods 19 or the leading ends of the claw pieces 20 push the rear end plate 3a of the pattern frame 3 until the engaging parts 31 of the pattern frame 3 are released from the laterally opposed rails 30 and slid on the means of conveyance 18. Then, to set the next pattern frame 3 in place inside the frame 11, the laterally opposed rods 19 are slightly moved backwardly and stopped, the guides 21 are advanced to separate the claws of the claw pieces 20 from each other, and the laterally opposed rods 19, upon entry of the next pattern frame 3 as carried on the means of conveyance 18, are advanced to the fullest possible extent until the claw pieces 20 grasp the laterally opposed edges of the rear end plate 3a of the pattern frame 3. Then, the laterally opposed rods 19 are moved backwardly. From this point on, the procedure described above is followed.

Desired molding of a concrete product is effected by separating the depression 32 on the lower side of the pattern frame 3 slightly upwardly from the upper side of the vibrating base 26 now held in its lowered position by the pistons of the cylinders 27, pushing the bottom plate 33 supporting the concrete product molded in the last round from the upper side of the vibrating base 26 onto a conveyor 37 by a pallet feeder 36 (FIG. 1, FIG. 3 and FIGS. 6 through 8) and, at the same time, feeding a new bottom plate 33 onto the vibrating base 26.

Figure 7:
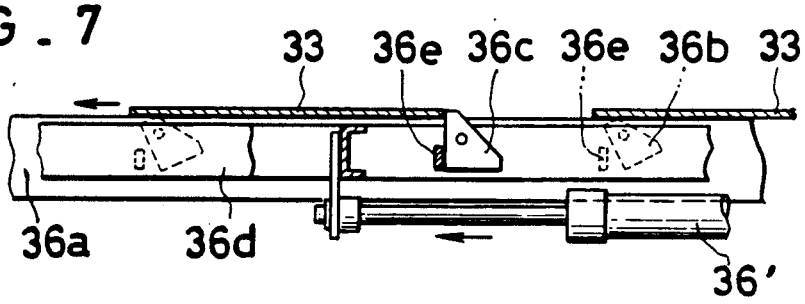
FIG. 7 is a front view of the pallet feeder of FIG. 6 held in an advanced position.
Figure 8:
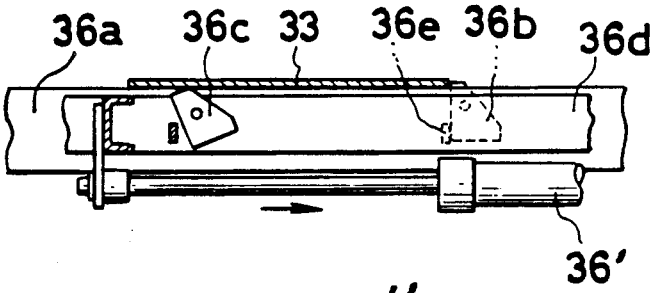
FIG. 8 is a side view of the pallet feeder of FIG. 6 in a retracted position.
Figure 9:
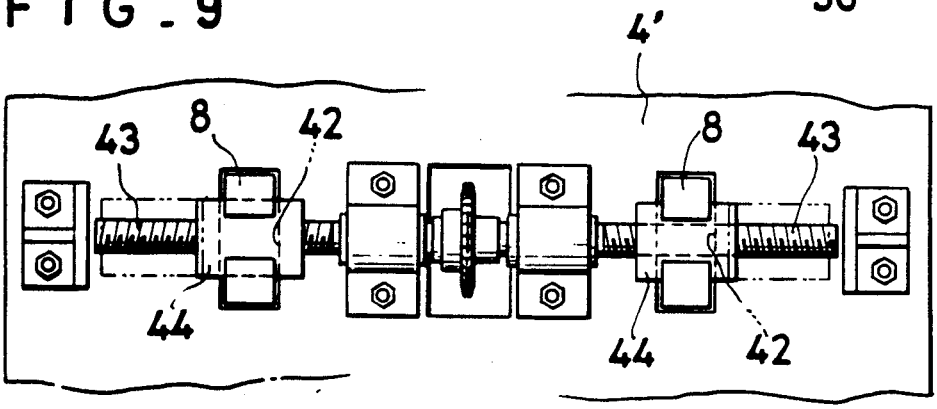
FIG. 9 is a plan view of means for attaching a fitting plate to a base plate of a press in the molding machine of FIG. 1, held in a joined state.
Figure 10:
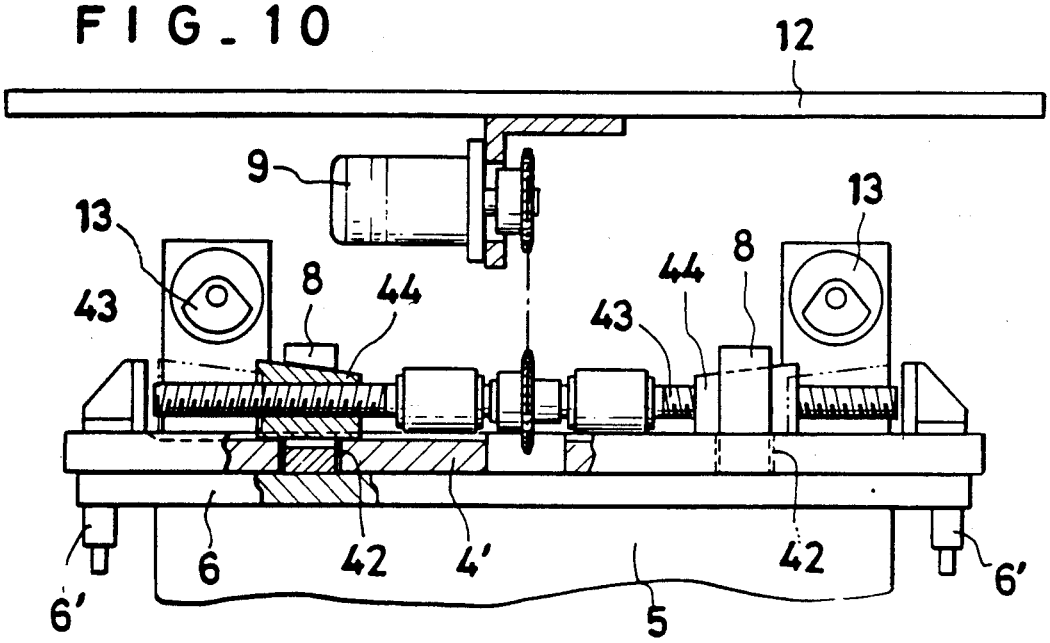
FIG. 10 is a front view illustrating the state in which the attaching means of FIG. 9 is joined.

The pallet feeder 36 is disposed inside the hopper frame 14 and is composed of laterally opposed and longitudinally extended stationary rails 36a having their upper surfaces flush with the upper side of the vibrating base 26 in the lowered state and serving to support thereon the bottom plate 33, laterally paired stationary rotary claws 36b disposed along the stationary rails 36a as longitudinally separated by a distance slightly greater than the length in the longitudinal direction of the bottom plate 33, a longitudinally movable traveling frame 36d provided with similar laterally opposed rotary claws 36c, and a piston cylinder 36' serving to move the aforementioned traveling frame 36d forwardly or rearwardly by a fixed stroke. The piston cylinder 36' imparts one complete reciprocation to the traveling frame 36d. During the forward travel of the traveling frame 36d, the bottom plates 33 mounted in a row as spaced slightly in the longitudinal direction on the laterally opposed stationary rails 36a are advanced as pushed by the lateral pairs of rotary claws 36c of the traveling frame 36d (at which time the lateral pairs of rotary claws 36b which are at rest are tilted forwardly by the advancing bottom plates, as shown in FIG. 7), the leading pair of rotary claws 36c located at the front end of the traveling frame 36d pass through a longitudinal space formed in the vibrating base 26 and push the bottom plate 33 supporting the molded concrete product and lying on the vibrating base 26 through the front open portion of the inserting part 34 onto the conveyor 37. The second pair of rotary claws 36b supply a new bottom plate from the upper sides of the stationary rails 36a onto the upper side of the vibrating base 26.

During the subsequent rearward travel of the traveling frame 36d, the leading pair of rotary claws 36b at rest catch hold of the rear end of the bottom plate 33 on the vibrating base 26 and the remaining pairs of rotary claws 36c receive the rear ends of the bottom plates 33 on the stationary rails 36a so that the bottom plates 33 will be prevented from moving backwardly together with the rotary claws 36c of the traveling frames 36d which are tilted forwardly and made to move backwardly under the bottom plates 33. The two groups of paired rotary claws 36b, 36c are so adapted as to be tilted forwardly to lose height but are prevented from rotating in the opposite direction by the stoppers 36e.

After the bottom plate 33 has been supplied onto the upper side of the vibrating base 26, the pattern frame 3 is lowered by the pistons of the cylinders 27 until the upper side of the pattern frame 3 comes flush with the deck 15 and, at the same time, the lower end of the cavity 3' of the pattern frame 3 is closed with the bottom plate 33 on the vibrating base 26. For this purpose, it suffices to lower the pistons of the cylinders 27 and bring the upper side of the depression 32 into contact with the bottom plate 33 where the pattern frame 3 is of a type used for molding concrete products of the largest possible thickness and, therefore, the upper side of the pattern frame 3 falls flush with the deck 15 when the pattern frame 3 is fit into the inserting part 34 as illustrated in FIG. 1 and FIG. 2 and the upper side of the depression 32 is brought into contact with the bottom plate 33 on the vibrating base 26. Where the height of the molding region of the pattern frame 3 or the depth of the cavity of the pattern frame 3 is smaller than the thickness mentioned above, it suffices to raise the vibrating base 26 by the piston of the cylinder 23 by the difference of the height and, at the same time, lower the pistons of the cylinders 27 until the upper side of the depression 32 comes into contact with the bottom plate 33 on the raised vibrating base 26 and the upper side of the pattern frame 3 falls flush with the deck 15. In either of the cases of pattern frames 3 of different thickness, the amount of the descent of the pistons of the cylinders 27 is constant. Until completion of the molding, the piston enables the laterally opposite rails 30 to keep the engaging part 31 of the pattern frame 3 drawn downwardly and the upper side of the depression 32 pressed against the bottom plate 33 so as to fixedly retain the pattern frame 3 in place. To facilitate determination of the amount of ascent of the vibrating base 26 produced by the piston of the cylinder 23 where the pattern frame 3 is of the type for molding concrete products of a thickness smaller than the largest possible thickness, there is provided thickness difference adjusting means which comprises a projection 38a disposed on the upper side of the elevating plate 24 and a stepped plate 38b containing a plurality of steps equalling various differences of thickness from the largest to the smallest possible thickness and attached so as to be moved by the piston cylinder 38'. The amount of the ascent of the vibrating base 26 is controlled by allowing the particular step of the plate 38b corresponding to the relevant difference of thickness of the pattern frame 3 to be opposite to the projection 38a and raising the piston of the cylinder 23 until the projection 38a comes into contact with the aforementioned step.

After the upper side of the pattern frame 3 comes flush with the deck 15, the material supply box 2 is advanced onto the pattern frame 3 and the vibrator 26' of the vibrating base 26 is set operating to fill the cavity 3' with concrete material. Then, the vibrator 26' is stopped and the material supply box 2 is retracted. Subsequently, by extending the piston of the press 4 downwardly and, at the same time, setting the vibrator 13 operating, the press die 5 is pushed down into the cavity 3' of the pattern frame 3 until the concrete material in the cavity is compressed to a required thickness. There is also provided means which, on detection of the moment at which the press die 5 begins to enter the cavity, actuates the vibrator 26' on the vibrating base 26.

A sensor 39 is disposed on the frame 11 and a contact piece 39' for operating the sensor is disposed on the motor base 12 in the present embodiment (FIG. 2). As the press die 5 compresses the concrete material in the cavity 3' to the required thickness, the contact piece 39' actuates the sensor 39 to discontinue the descent of the piston of the press 4 and the operation of the vibrators 13, 26' and, at the same time, raises the pistons of the cylinders 27. The aforementioned pallet feeder 36 causes the molded concrete product on the vibrating base 26 to be pushed out onto the conveyor 37 and raises the pattern frame 3 to the height at which a new bottom plate is fed onto the vibrating base 26. The height of this ascent is required to be such that the upper side of the depression 32 of the pattern frame 3 is separated from the upper side of the bottom plate 33 on the vibrating base 26 by a distance slightly greater than the thickness of the concrete product of the largest possible thickness. By allowing the sensor to detect a fixed proportion of this ascent of the pattern frame 3, the vibrator 13 of the press 4 is set operating and the piston of the press 4 is actuated to raise the press die 5 to the formerly elevated position. The vibrator 13 is stopped when the press die 5 is pulled up from the cavity 3'. As a result, the molded concrete product released from the mold is mounted on the bottom plate 33 held disposed on the vibrating base 26. The traveling frame 36*d* of the pallet feeder 36 is advanced to push the concrete product onto the conveyor 37 and supply a new bottom plate 33 onto the vibrating base 26. From this point on, the operation described above is repeated.

Sensor means 40 for detecting the elevation of the pattern frame 3 is formed of proximity switches disposed as spaced vertically on the frame as juxtaposed to any one of the elevating rods 29 adapted to reciprocate vertically in conjunction with the piston of the cylinder (FIG. 1) so as to detect for necessary control the position at which the pallet feeder 36, on being actuated by the projection 29' disposed on the elevating rod 40', raises the pattern frame 3 to permit supply of the bottom plate 33, the position at which the press 4 is elevated in the meantime, and the position at which the pattern frame 3 is pushed up above the deck 15 to permit change of pattern frames 3.

When the press die 5 is lowered to compress the concrete material in the cavity 3' of the pattern frame 3, the pattern frame 3 for molding concrete products of the largest possible thickness is enabled to receive the compressive force as dispersed in the frame 11 through the stationary base 22 because the lower ends of the legs 24' are pressed against the bottom plate 33 on the upper side of the vibrating base 26 now held in the lowered state and, therefore, held in contact with the shock-absorbing rubber member 22' on the stationary base 22. When the pattern frame 3 is of a type for molding concrete products of a smaller thickness, the compressive force exerted during the press molding is required to be received by the cylinder 23 because the piston of the cylinder 23 is holding up the vibration base 26 for the purpose of keeping the upper side of the pattern frame 3 flush with the deck 15. In the case of the pattern frame 3 used for molding concrete products of a thickness smaller than the largest possible thickness, the compressive force exerted for press molding after the cavity 3' has been filled with the concrete material from the material supply box 2 is desired to be dispersed in the frame through the stationary base plate 22 by causing the elevating plate 24, the vibrating base 26, and the pattern frame 3 to be synchronously lowered by the pistons of the cylinders 23, 27 and allowing the lower ends of the legs 24' of the elevating plate 24 to come into contact with the shock-absorbing rubber member 22' on the stationary base plate 22.

To fix the thickness of concrete products molded under the compression generated by the press die 5, a plurality of sensors 39 or contact pieces 39' of varying thickness are provided so that a particular sensor 39 or contact piece 39' proper for the prescribed thickness of concrete products may be selected and set in place to effect desired stop of the descent of the piston of the press 4 after the concrete material has been compressed to the aforementioned prescribed thickness.

Now the means of attachment 7, 8 for uniting and disconnecting the press 4 and the press die 5 and the drive means 9 used for their operation will be described below.

In the first embodiment, the base plate 6 of the press die 5 is provided, as means of attachment, along the laterally opposed edges on the upper side thereof with projecting pieces 8 containing an upward opening 41 of a cross section of the shape of the inverted letter T, and the fitting plate 4' of the press 4 is provided, as means of attachment, with laterally opposed holes 42 allowing the aforementioned projected pieces 8 to pass therethrough and emerge from the upper sides thereof. Turnbuckles 43 are laid directly above the laterally opposite rows of holes 42 and supported rotatably in place, and two wedges 44 helically meshed with the righthand threads and the lefthand threads of the turnbuckles 43 and adapted to move over the fitting plate 4' in the longitudinal direction of the turnbuckles. The drive means 9 is a hydraulic motor fixed in place on the lower side of the motor base 12 and adapted to rotate and drive the aforementioned turnbuckles 43 in either direction such as by chain transmission (FIGS. 1, 2, 9, and 10).

As described above, the pattern frame 3 is transferred from the means of conveyance 18 to the pistons of the cylinders 27 elevated to its uppermost reach by allowing the laterally opposed engaging parts 31 of the pattern frame 3 to be drawn into the gap between the laterally opposed rails 30 on the upper end of the piston 23 by the pair of laterally opposed rods 19. The wedges 44 are kept clear of the holes 42 while the press 4 is lowered to bring the fitting plate 4' into contact with the upper side of the base plate 6 disposed atop the press die 5. As a result, the projected pieces 8 enter the holes 42 and emerge from the fitting plate 4', the laterally opposed threads of the turnbuckles 43 enter the upward openings in the projecting pieces 8, and the lower side of the fitting plate 4' comes into contact with the upper side of the base plate 6 when the press 4 is lowered. Then, the upper side of the fitting plate 4' and the upper sides of the openings 41 of the projecting pieces 8 are fixedly joined with wedges 44 by rotating the turnbuckles 43 in one direction with the drive means 9, moving the wedges 44 toward each other on the fitting plate 4', and causing the wedges 44 to advance into the grooves of the laterally opposed projecting pieces 8. Desired breakage of this union is accomplished by rotating the turnbuckles 43 in the reverse direction with the drive means 9 until the wedges 44 are withdrawn from the projecting pieces 8. The upper sides of the openings 41 in the projecting pieces 8, therefore, are inclined in advance in conformity with the inclination of the upper sides of the wedges 44. The turnbuckles 43 are movably supported to a small extent in the axial direction so that when one of the wedges 44 tends to go into engagement with the corresponding projecting piece 8 slightly earlier than the other wedge 44 such as because of error in the fabrication of the inclined surfaces of the projecting pieces 8 and the wedges 44, these turnbuckles 43 will be drawn enough for the projecting pieces 8 to be moved and brought into secure engagement with the wedges 44 at the same time.

FIG. 11 illustrates the second embodiment of this invention. In this embodiment, the means of attachment for the union of the press 4 and the press die 5 comprises an electromagnetic table 45 disposed on the lower side of the fitting plate 4', pins 46 projecting downwardly from the laterally opposed parts of the fitting plate 4', the base plate 6 itself which is attracted by the electromagnetic table 45, and holes 46' bored in the laterally opposed parts of the base plate 6 for admitting the aforementioned pins 46. The feed means, therefore, is a power feed unit for the electromagnetic table 45.

In this arrangement, the press 4 is lowered for allowing the pins 46 to enter the holes 46' in the base plate 6 assembled on the press die 5 and the lower side of the fitting plate 4' to come into contact with the upper side of the base plate 6. In this state, the electromagnetic table 45 is energized to attract the base plate 6 with electromagnetic force. The aforementioned pins 46 and holes 46' prevent relative motion in the horizontal direction between the base plate 6 and table 45 attracted together by electromagnetic force. Optionally, such electromagnetic tables 45 may be provided one each on the upper sides of the base plates 6 having a press die 5 attached thereto.

The second embodiment differs conspicuously from the first embodiment described above not merely in respect of the aforementioned means of attachment 7, 8 and the drive means 9 but also in the arrangement for retaining a molding region by causing the pattern frame 3 to be introduced into the molding machine below the deck 15 by push-pull rods (not shown) and then causing the pattern frame 3 to be pulled up and inserted into the inserting part 34 of the deck by cylinders 47 attached to the motor base 12 with the pistons thereof extending downwardly.

To materialize this arrangement, the engaging parts 31 for the pattern frame 3 are attached through shock-absorbing rubber members 31' to the upper side of the pattern frame 3 so as to extend upwardly from the laterally opposed edges of frame 3. The laterally opposed rails 30 for retaining by engagement the engaging parts 31 are attached to the lower sides of the pistons of the cylinders 47.

Desired setting of the pattern frame 3 and the press die 5, therefore, is attained by lowering the laterally opposed rails 30 with the pistons of the cylinders 47 until they come flush with the engaging parts 31 of the pattern frame 3 on the means of conveyance 18, causing the pattern frame 3 from being drawn in by the push-pull rods 19 to be received by the laterally opposed rails 30, stopping the motion of the pattern frame 3 when the pattern frame 3 arrives directly under the inserting part 34, lowering the piston of the press 4 thereby joining the press 4 die 5 with the press as described above, raising the press 4, and releasing the press die 5 onto the pattern frame 3.

In FIG. 11, the left half of the pattern frame 3 represents the state in which the laterally opposed rails 30 have received the pattern frame 3 from the means of conveyance 18 and the right half thereof represents in solid line the state in which the pistons of the cylinders 47 draws up the pattern frame 3 until the upper side thereof comes flush with the deck 15 and the cavity 3' is filled with the concrete material released from the material supply box 2.

Desired molding of the concrete product is attained by elevating the vibrating base 26 with the piston of the cylinder 23 toward the depression on the lower side of the pattern frame 3 held in the state indicated by the solid line in the right half of FIG. 11 thereby closing the lower end of the cavity 3' with the bottom plate 33 on the upper side of the vibrating base 26, feeding the concrete material into the cavity 3', then synchronously lowering the pistons of the cylinders 23, 47 thereby lowering the pattern frame 3 and the vibrating base 26 and allowing the legs 24' of the elevating plate 24 to come into contact with the shock-absorbing rubber members 22' on the stationary base 22 and, at the same time, pressing the depression on the lower side of the pattern frame 3 against the upper side of the vibrating base 26 through the bottom plate 33 (as indicated by the broken line in the right half of FIG. 11), compressing the concrete material in the cavity 3' to the prescribed thickness with the press die 5 in the same way as in the first embodiment, then handling the pattern frame 3 and the press die 5 similarly thereby releasing the molded concrete product onto the bottom plate 33 on the vibrating base 26 and allowing the upper side of the pattern frame 3 to come flush with the deck 15, transferring the bottom plate 33 from the vibrating base 26 onto the conveyor 37 with the pallet feeder 36 and feeding a new bottom plate 33 onto the vibrating base 26, and repeating the procedure described above.

Desired change of the pattern frame 3 and the press die 5 and their replacements is attained by elevating the pattern frame 3 until it assumes the state indicated in the left half of FIG. 11, actuating the press 4 thereby allowing the press die 5 to be lowered onto and joined with the pattern frame 3, suspending the supply of electricity to the electromagnetic table 45 and, at the same time, elevating the press 4, then advancing the push-pull rods 19 and enabling the claw pieces 20 thereof to give a push to the rear end plate 3*a* of the pattern frame, and releasing the pattern frame 3 from the laterally opposed rails 30 onto the means of conveyance 18.

A few other versions of the means of attachment 7, 8 and the drive means 9 will be described below with reference to FIGS. 12 through 15.

Figure 12:
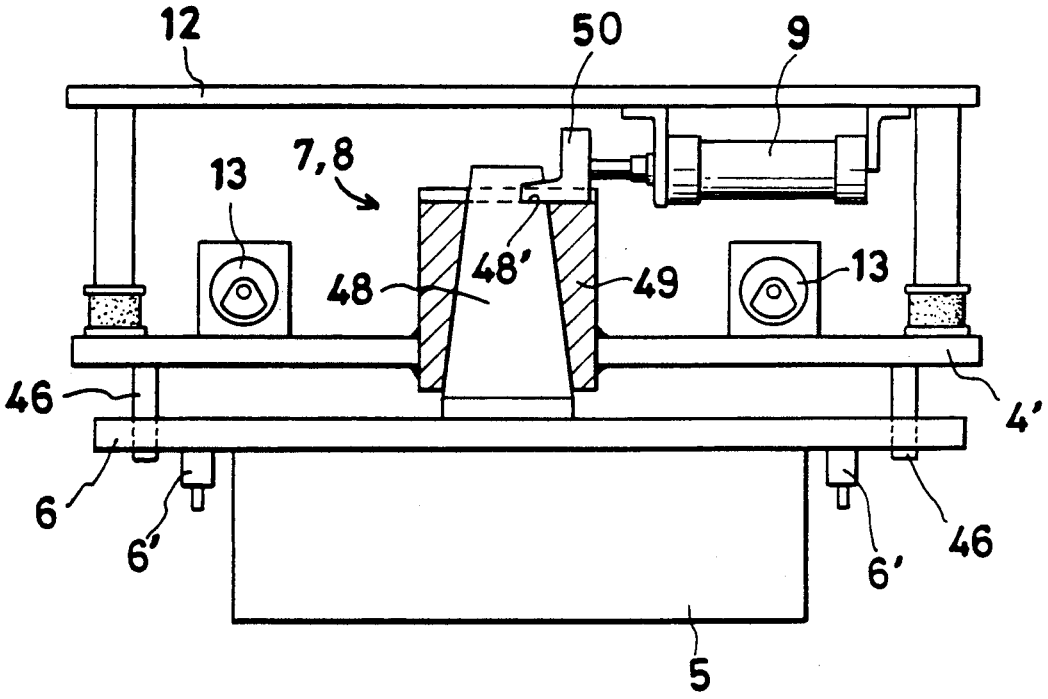
FIG. 12 is a front view of another means for attaching the fitting plate to the base plate of the press according to the present invention.

In the embodiment of FIG. 12, an upwardly converging wedge member 48 having the shape of a truncated cone is raised as means of attachment 8 from the center of the upper side of the base plate 6. In the fitting plate 4' of the press 4, a hollow inserting member 49 provided with a tapered hole allowing the aforementioned wedge member 48 to pass upwardly therethrough and thrust out of the upper end thereof, and an engaging piece 50 enabled to plunge into a notch 48' formed on a lateral side of the wedge member 48 are disposed to serve jointly as means of attachment 7. On the lower side of the motor base 12, a hydraulic piston cylinder 9 is disposed to serve as drive means for reciprocating the engaging piece 50.

Optionally, particularly when the wedge member 48 has a conical shape, the fitting plate 4' is provided with downwardly extending pins 46 in the same way as in the second embodiment of FIG. 11 and the base plate 6 is provided with holes 46' for admitting the pins 46 for the purpose of preventing the press die 5 from rotating relative to the press.

The pattern frame 3 and the press die 5 are introduced by the push-pull rods 19 above or below the inserting part 34 within the frame 11 and the laterally opposed rails 30 receive the pattern frame 3 and the press die 5 from the means of conveyance 18. Then, the engaging piece 50 is retracted and the press 4 is lowered and the hollow inserting member 49 is fitted around the conical member 48 of the press die 5. After the inserting member 49 and the conical member 48 have formed a perfect union, the engaging piece 50 is advanced by the piston cylinder of the drive means 9 and the engaging piece 50 is allowed to plunge into the notch 48' on the lateral side of the conical member 48 and the press die 5 is joined to the lower side of the press 4.

Desired breakage of the union is attained by lowering the press thereby joining the press 4 die 5 on the pattern frame 3, and retracting the engaging piece 50 with the piston cylinder 9 of the drive means thereby releasing it from the notch 48' in the conical member 48.

The drive means is not limited to the hydraulic piston cylinder. It may be an electromagnetic solenoid which has an exciting means normally biased such as with a spring so as to urge the engaging piece 50 in the direction of insertion within notch 48' in the conical member.

Figure 13:
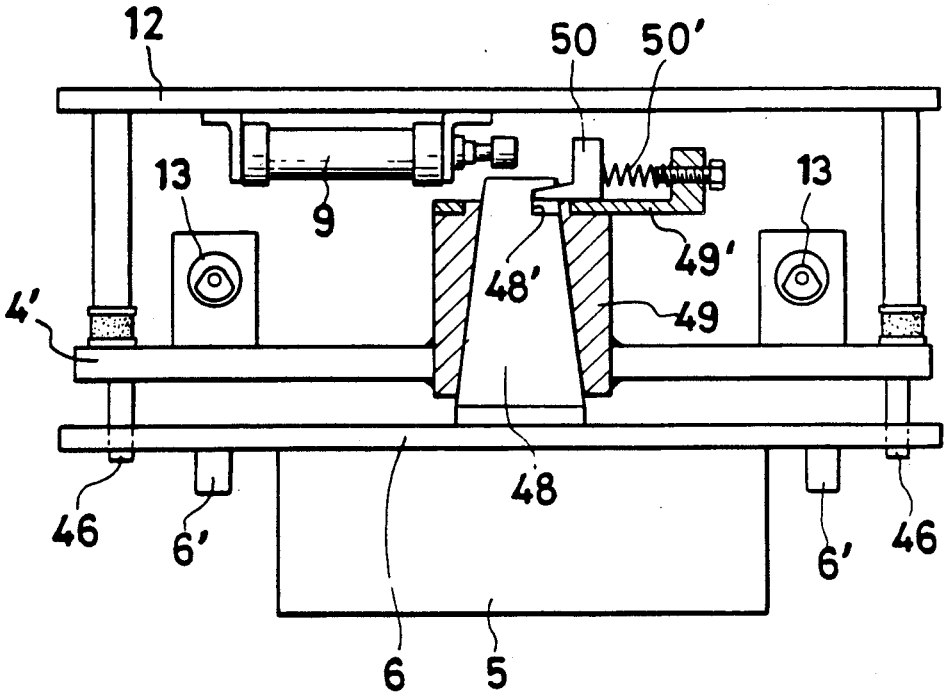
FIG. 13 is a front view of yet another means for attaching the fitting plate to the base plate.

The means of attachment illustrated in FIG. 12 has the engaging piece 50 attached to the piston end of the piston cylinder 9 or to the leading end of the exciting level means of the electromagnetic solenoid. Alternatively as illustrated in FIG. 13, the engaging piece 50 may be fixed on a base 49' at the upper end of the hollow inserting member 49 and, on this base 49', it may be urged such as with a spring 50' in the direction of forming a union with the notch 48' in the conical member 48. In this arrangement, the engaging piece 50 is provisionally retracted against the spring 50' by the operation of the drive means 9 such as, for example, a piston cylinder and a solenoid, the press 4 is lowered and, after the conical member 48 and the hollow inserting member 49 have been fitted against each other, the drive means 9 is retracted and the engaging piece 50 is advanced by the spring 50', the engaging piece 50 is caused by the force of the spring 50' to be engaged with the notch 48' in the conical member 48 and the press die 5 is joined with the press 4.

Naturally, this union is broken by withdrawing the engaging piece 50 by the drive means 9 against the resistance offered by the spring 50' and separating the press 4 upwardly from the press die 5.

In the embodiments of FIG. 12 and FIG. 13, the upper surface of the notch 48' in the conical member 48 and the upper surface of the engaging piece 50 designed for insertion into and engagement with the notch 48' are designed to form inclined or wedged surfaces so that the insertion of the engaging piece 50 will cause an conical member 48 to be pulled upwardly with the upwardly directed component of force as piece 50 is inserted within notch 48'.

Figure 14:
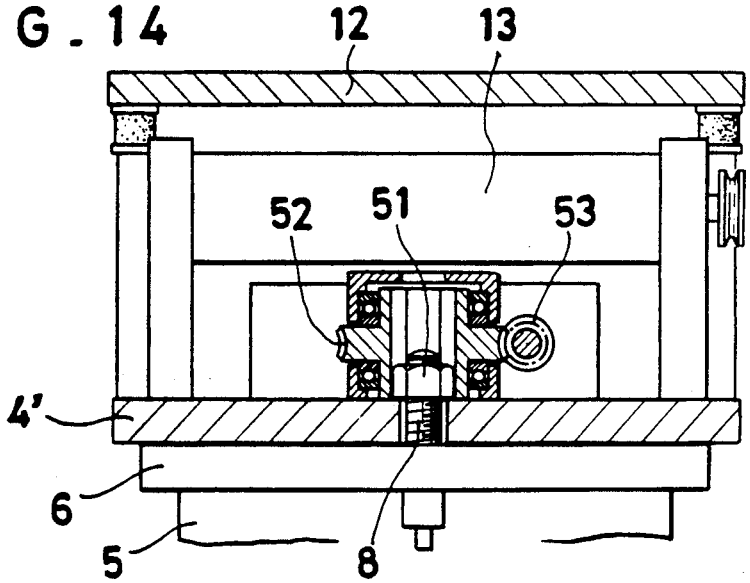
FIG. 14 is a front view of still another means for attaching the fitting plate to the base plate.
Figure 15:
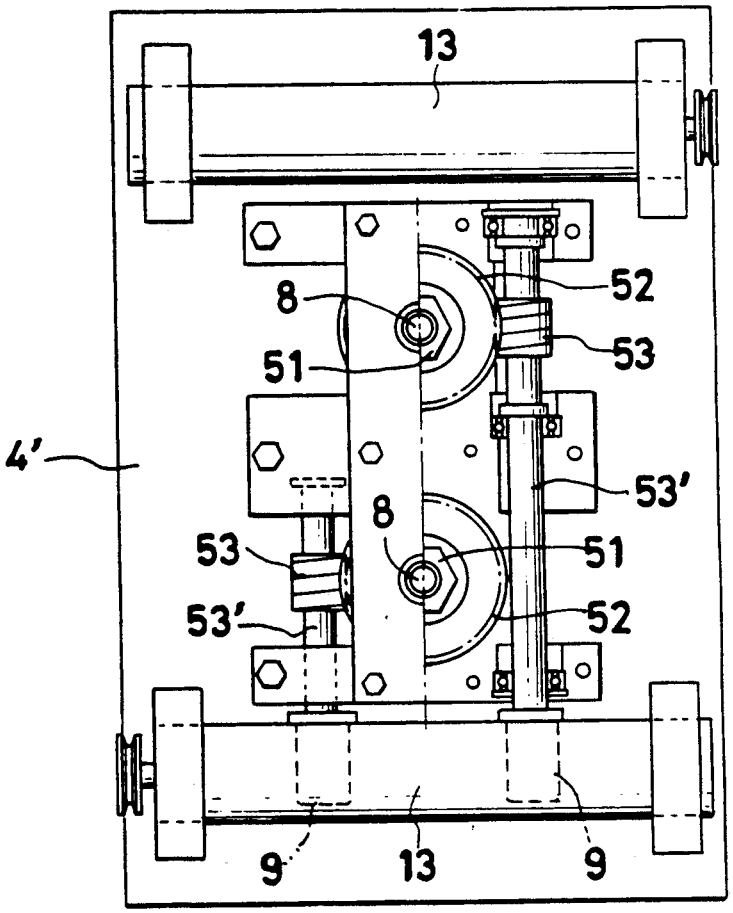
FIG. 15 is a partially sectioned plan view of the attaching means of FIG. 14.

In the embodiment of FIG. 14 and FIG. 15, bolts 8 are disposed in the upper side of the base plate 6 and holes enabling the bolts 8 to pass therethrough and thrust upwardly from the upper side thereof when the fitting plate 4' of the press 4 collides against the upper side of the base plate 6 are formed in the fitting plate 4' and worm wheels 52 each having a nut 51 inserted in the inner wall thereof are rotatably retained directly above the aforementioned holes to give rise to means of attachment 7. The drive means 9 is formed of worms 53 meshed with the worm wheels 52 and a hydraulic motor capable of rotating shafts 53' of the worms 53 and thereby moving the worms 53 in either direction. The inner wall of each worm wheel 52 has a polygonal cross section conforming to the outer shape of the nut 51 so that the worm wheel 52 and the nut 51 will rotate in unison. Further, the nut 51 is vertically movable along the inner wall of the worm wheel 52. As the press and the press 4 die 5 are brought into fast mutual contact, the bolt thrusts into the inner wall of the worm wheel 52 so much as to push up the nut 51. When the worm wheel 52 is subsequently rotated and driven in one direction by the hydraulic motor and the worm 53, the nut 51 is rotated in conjunction with the worm wheel 52 and consequently driven onto the bolt 8, with the result that the nut 51 is tightened against the upper side of the fitting plate and the press die 5 is joined to the lower side of the press 4. This union is broken simply by rotating and driving the worm wheel 52 in the reverse direction with the hydraulic motor and the worm 53.

The present embodiment does not exclusively contemplate use of just one set of a bolt 8 and a nut-containing worm wheel 52. A plurality of such sets may be used as disposed in laterally opposed positions as illustrated. In this case, the worm wheels 52 are desired to be severally rotated and driven by their own hydraulic motors and worms.

Various other configurations are conceivable for the means of attachment 7, 8 and the drive means 9. Virtually any configuration can be adopted for these essential components of the molding machine of the present invention on the condition that, in the configuration adopted, these components enable the base plate 6 to be joined to or disconnected from the lower side of the fitting plate 4' as quickly and safely as possible.

In the molding machines described above as the first and second embodiments of this invention, the cavities 3' of the pattern frames 3 are invariably opened vertically. In contrast, in the third embodiment illustrated in FIG. 16 and FIG. 17, the molding machine effects molding of concrete products in a pattern frame 3 the cavity 3' of which is closed on the bottom. The pattern frame in the present embodiment obviates the necessity for any bottom plate. Instead, it is required to be turned upside down to release the molded concrete product. In this embodiment, therefore, laterally opposed bearings 54 disposed halfway along the height of the frame 11 rotatably support thereon hollow shafts 55' protruding from the laterally opposed sides of a U-shaped rotary frame 55, laterally opposed rails 30 fixed on the bottom of the rotary frame 55 are supported on upwardly extending piston cylinders 56 so as to be engaged one each with the engaging parts 31, rails 30 being disposed at laterally opposed positions on the lower side of pattern frame arms 57 provided with shock-absorbing rubber members 57' and the leading ends of the arms 57 are disposed within horizontal grooves 58 formed within opposed lateral sides of the pattern frame 3. The rotary frame 55 also includes an auxiliary deck 15' which falls flush with the deck 15 of the hopper frame 14.

Each of the hollow shafts 55' supported by the bearings 54 is pierced by an axle 59 having pulleys fixed one each at the opposite ends thereof. By means of these axles 59, the rotation of the motor $M_2$ installed on the frame 11 is transmitted by belts to vibrators 60 fixed severally on the front side and the rear side of the pattern frame 3. On at least one of the hollow shafts 55' is fixed a sprocket wheel 61. A chain 62 reciprocated by a hydraulic motor (not shown) disposed on the frame 11 or on the hopper frame 14 is laid around the wheel 61 so as to rotate the rotary frame 55 in either direction.

The pattern frame 3 and the press die 5 disposed thereon as correctly positioned relative to the cavity 3' thereof are set in place within the rotary frame 55. This setting is attained by keeping the laterally opposed rails 30 elevated with the pistons of the cylinders 56, introducing the parts 31 from the means of conveyance 18 into the rotary frame 55 with the aforementioned laterally opposed push-pull rods 19, and inserting the engaging parts 31 and the grooves 58 in the rails 30 and the arms 57, respectively, so as to be supported inside the frame 55. Then, the press 4 is lowered and, in the present embodiment similarly to the second embodiment, the press die 5 is joined to the lower side of the press 4 with the electromagnetic table 45, the pins 46, and the holes 46', subsequently the press 4 is elevated, and the press die 5 is separated upwardly from the pattern frame 3. The pattern frame 3 and the press die 5 are transferred onto the means of conveyance 18 for the purpose of change with replacements. This transfer is attained by reversing the procedure described above and then pushing them out with the laterally opposed rods 19. The molding of concrete products is effected by passing endless belts around the pulleys at the opposite ends of the axles 59 protruding into the rotary frame 55 and the pulleys of the vibrators 60 fixed on the front and rear sides of the pattern frame 3, lowering the pistons of the cylinders 56, thereby causing the engaging parts 31 to be pulled downwardly with the laterally opposed rails 30 against the shock-absorbing rubber members 57' of the arms 57, allowing the pattern frame 3 to be retained within the rotary frame 55 and, at the same time, causing the upper side of the pattern frame 3 to come flush with the deck 15 and the auxiliary deck 15'.

Then, the concrete material released from the material supply box 2 is poured into the cavity 3' under vibration until the cavity 3' is filled. Now, the press die 5 is lowered to compress the concrete material in the cavity 3' still under vibration until the concrete material is molded to the prescribed thickness. The press die 5 is separated upwardly and the molded concrete product is manually trimmed as is well known. Otherwise, the concrete product in the cavity 3' is capped with a plane pallet fixed to the pattern frame 3 and the rotary frame 55 is turned upside down by the sprocket wheel 61 and the chain 62. An elevating base 64 is fixed horizontally to the upper ends of the pistons of cylinders 63 disposed at the lower end of the molding frame 11 to remove the plane pallet from the pattern frame 3 and release the concrete product in conjunction with the plane pallet onto the elevating base 64. The elevating base 64 is then lowered to transfer the concrete product onto a conveyor.

After the release of the concrete product from the pattern frame 3, the rotary frame 55 is turned through a half circle until the opening of the cavity faces upwardly. Then, the procedure described above is repeated. In the present embodiment, since the pattern frame 3 is not required to be moved vertically to such a large extent as in the case of the first and second embodiments, the cylinders 56 having the laterally opposed rails 30 fastened to the upper ends thereof may be of a type effectively operated with a small stroke.

Figure 18:
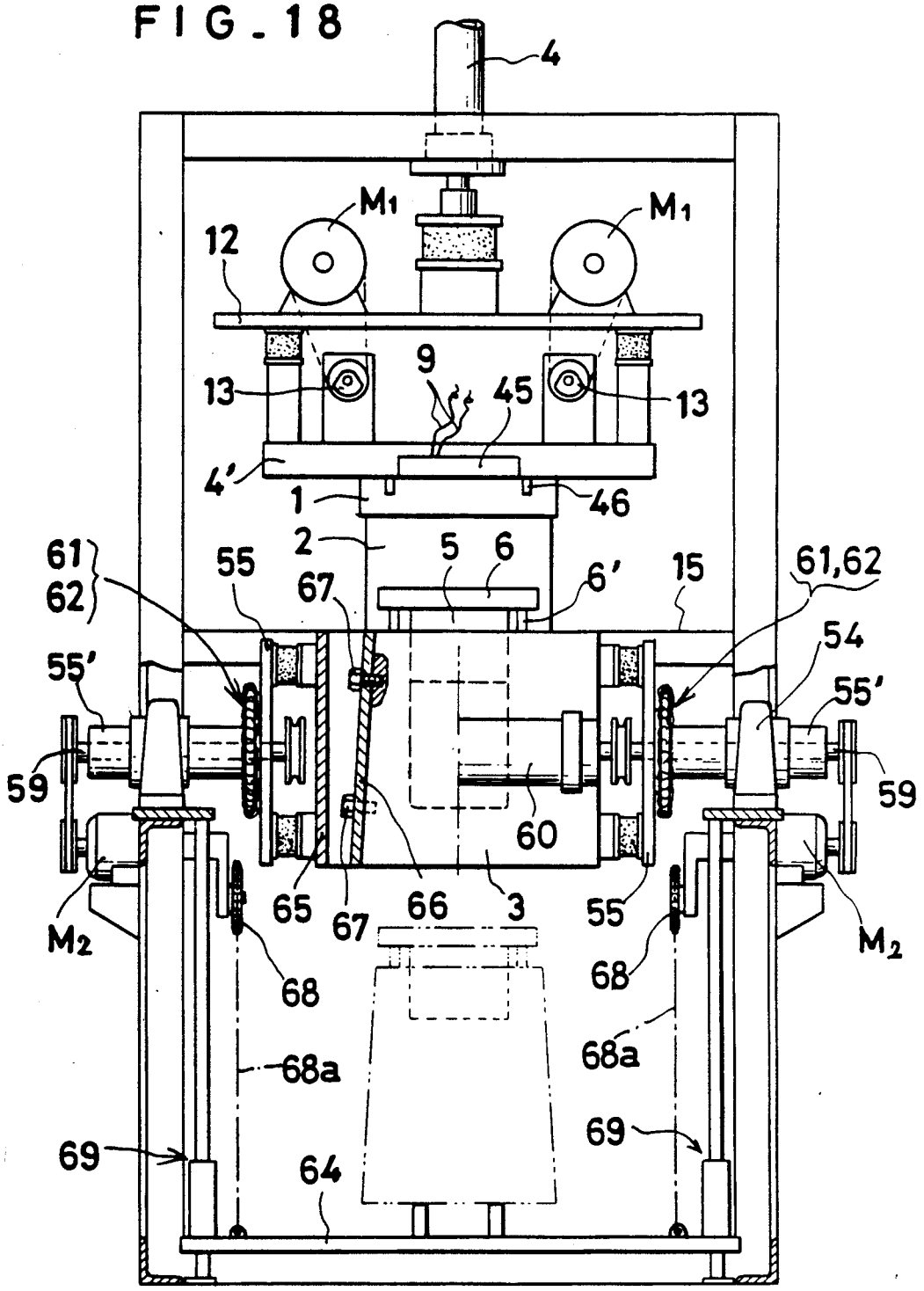
FIG. 18 is a front view of a molding machine, partly in cross section, adopting the fourth embodiment of the present invention.

The molding machine illustrated as the fourth embodiment of this invention in FIG. 18 is possessed of the rotary frame 55 and the elevating base 64 for release of the molded concrete product similarly to the third embodiment. Thus, similar reference numerals refer to members of similar functions and descriptions of such members are omitted to avoid needless repetition.

The rotary frame 55 in this embodiment comprises two opposed plates each provided with a sprocket wheel 61. Between these plates is fixed, through shock-absorbing rubber members, a box 65 open at the upper and lower ends and serving to hold the pattern frame 3 therein. Inside this box 65, an inner frame 66 permitting insertion therein of the pattern frame 3 is fixed at a distance from the walls of the box 65.

The press die 5 and the pattern frame 3 joined to each other with the press die 5 inserted downwardly into the cavity 3' are mounted on the loading bed of a forklift (not shown) and placed on the elevating base 64 now held in its lowered state. The elevating base 64 is elevated to insert the pattern frame 3 into the inner frame 66. Bolts 67 are manually inserted into the gap between the inner frame 66 and the box 65 and they are passed through the aligned holes in the inner frame 66 and the pattern frame 3. Then the bolts 67 are screwed into the threaded holes in the pattern frame 3 to fasten the pattern frame 3 to the outer sides of the inner frame 3. As a result, the pattern frame 3 is fixed to the inner frame. Then, the press 4 is lowered and the press die 5 is joined to the lower side of the press 4 similarly to the third embodiment. Desired change of the press die 5 and the pattern frame 3 and their replacements is attained by reversing the procedure described above.

The molding of concrete products is accomplished similarly to the third embodiment. The interior of the inner frame 66 is tapered so that the cross section of the interior decreases upwardly. The exterior of the pattern frame 3 is correspondingly tapered. The pattern frame 3 and the inner frame 66 are designed to have such dimensions that when the pattern frame 3 is inserted upwardly into the interior of the inner frame 66 and their tapered wall surfaces come into perfect mutual contact, the upper side of the pattern frame 3 will fall flush with the deck 15 of the material supply box 2.

The elevating base 64 in the present embodiment is not in the form of a cylinder. Similarly to the fifth embodiment to be described afterward, the elevating base 64 is suspended from the lower ends of chains **68*a* which are passed around and suspended from laterally opposed sprockets 68. In the same way as a bucket hoister, the elevating base 64 is raised by pulling the chains 68*a*. For guiding the ascent of the elevating base 64, therefore, there is provided a preventing means 69 adapted to keep the elevating base 64 from swinging while in motion. The preventing means 69 in the present embodiment comprises guide tubes erected upright at the four corners of the elevating base 64 and four guide posts erected on the frame 11** and adapted to slide the guide tubes in the vertical direction.

Figure 19:
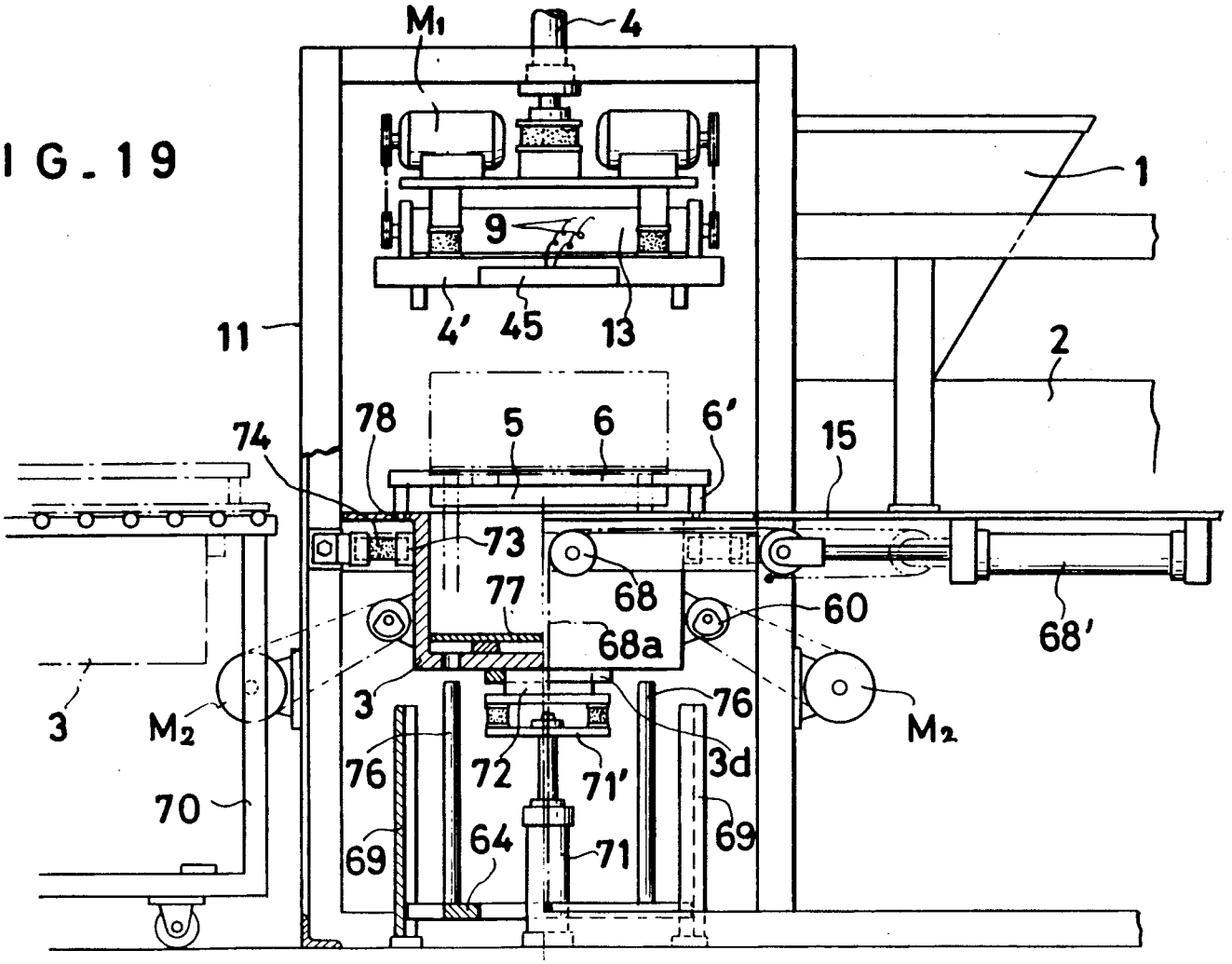
FIG. 19 is a side view of a molding machine, partly in cross section, adopting the fifth embodiment of the present invention.
Figure 20:
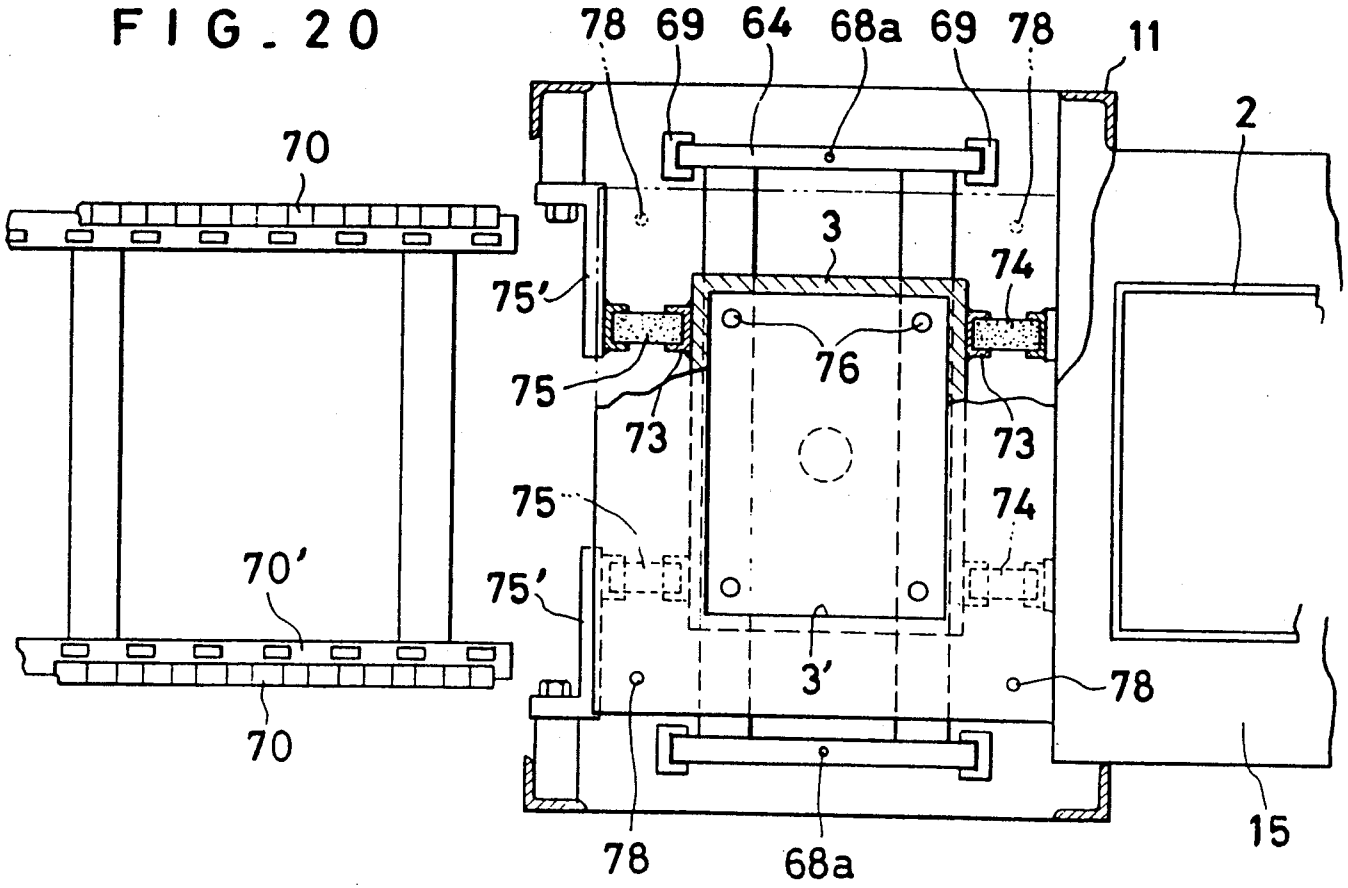
FIG. 20 is a plan view of the molding machine of FIG. 19.

In the molding machine illustrated in FIG. 19 and FIG. 20 as the fifth embodiment of this invention, piston cylinders 68' serve to stretch or loosen the chains 68*a* for the purpose of raising and lowering the elevating base 64 in the manner of a hoist. The swing-preventing means 69 comprises guides which are erected upright on the frame 11 and are disposed at the four corners of the elevating base 64.

Near the four corners of the base plate 6 having the press die 5 fastened to the lower side thereof, downwardly extending pins 6' are screwed in. When the base plate 6 is mounted on the pattern frame 3 with the lower ends of these pins 6' held in contact with the upper side of the flange protruding from the periphery of the upper end of the pattern frame 3, the lower end of the press die 5 is slightly separated above the upper side of the pattern frame 3. The press die 5 can no longer be positioned correctly relative to the cavity 3' and assembled on the pattern frame 3. In this embodiment, therefore, the pins 6' are provided at the lower ends thereof with protuberances of a small diameter and the flange of the pattern frame 3 is provided with holes 78 adapted to admit the aforementioned protuberances when the press die 5 and the cavity 3' are aligned vertically with respect to each other. By inserting the protuberances into the corresponding holes 78, therefore, the press die 5 is correctly positioned relative to the cavity 3' and assembled on the pattern frame 3. In other words, the protuberances of the pins 6' and the holes 78 serve as a kind of jig for the positioning of the press die 5 relative to the cavity 3'. Before the molding of concrete products, these are removed from the base plate 6. While the molding of concrete products is in progress, the pins 6' are kept out of use.

As the press die 5 is correctly positioned and assembled on the pattern frame 3, the pattern frame 3, with the laterally opposed parts of the flange thereof held up on the rollers of traveling trolley 70 movable on wheels, is transported by the traveling trolley 70 to the open front side of the molding frame 11. This traveling trolley 70 includes expansible frames 70' which can be extended upwardly on the laterally opposite sides thereof and thrust into the molding frame 11. The flange of the pattern frame 3 also rides on the rollers on the upper side of the expansible frames 70'. When the traveling trolley 70 is stopped after the leading end thereof has reached the front side of the frame 11, the expansible frames 70' are extended into the molding frame to move the press die 5 and the pattern frame 3 so as to set them in place within the molding region inside the frame 11 and allow the upper side of the flange of the pattern frame 3 to fall flush with the deck 15.

At the center in the lower end portion of the frame 11, a cylinder 71 having an upwardly extending piston attached thereto is disposed. To the upper end of the piston, an elevating plate 71' is horizontally fixed. On this elevating plate 71', a magnetic table 72 is fixed through a shock-absorbing rubber member. The pattern frame 3 can be fixed on the elevating plate 71', therefore, by raising the piston of the cylinder 71, allowing the electromagnetic table 72 to come into contact with the lower side of the pattern frame 3, and energizing the electromagnetic table 72 thereby enabling the electromagnetic table 72 to attract the lower side of the pattern frame 3. The pattern frame 3 is provided on the lower side thereof with a frame 3*d* for enclosing the electromagnetic table 72 therein. The electromagnetic table 72 is inserted into the space enclosed by the frame 3*d* and attracted to the lower side of the pattern frame 3. Owing to this frame 3*d*, the pattern frame 3 and the electromagnetic table 72 are prevented from undergoing relative motion while the molding of concrete products is in progress.

After the pattern frame 3 has been fixed on the elevating plate 71' by the electromagnetic table 72, the expansible frames 70' are withdrawn from the molding frame 11.

The pattern frame 3 is possessed of receiving channels 73 disposed one each at the laterally opposite edges of the front side and the rear side thereof and adapted to permit insertion of the edge portions of a shock-absorbing rubber member. The receiving channels 73 on the rear side, when moved into the frame by the expansible frames 70', permit insertion therein of the edge portion of the shock-absorbing member 74 protruding inwardly from the frame 11.

After the expansible frames 70' have been withdrawn from the molding frame 11, member 75' provided with a shock-absorbing members 75 whose edge portions are designed to be inserted into the receiving channels 73 in the front side of the pattern frame 3 is fixed as with bolts to the open front side of the frame 11. Thus, the pattern frame 3 is nipped on the front and rear sides thereof by the shock-absorbing rubber members 74, 75 to retain the molding region therein. The member 75' comprises two pieces each provided with a shock-absorbing rubber member 75 designed to be inserted into the laterally opposed receiving channels 73 on the front side of the pattern frame 3. Naturally, the aforementioned two pieces may be formed as a continuous member.

Before or after the member 75' is fixed in place, the press 4 is lowered and, in the present embodiment, joined to the press die 5 with the electromagnetic table 45 and the pins 46, and the endless belts are stretched between the vibrators 60, disposed on the front and rear sides of the pattern frame 3, and the motors $M_2$ fixed on the frame 11.

Desired change of the pattern frame 3 and the press die 5 and their replacements is attained, therefore, by attaching the pins 6' to the lower side of the base plate 6 and reversing the procedure described above.

In the present embodiment, the cavity 3' is provided at the four corners of the bottom thereof with holes and the elevating base 64 is provided with four upright pillars 76 adapted to enter the aforementioned holes upwardly.

Desired molding of concrete products is attained by manually laying the bottom plate 77 inside the cavity 3', then feeding the cavity 3' with concrete material from the material supply box 2, pushing the press die 5 downwardly into cavity 3' to compress the concrete material to the prescribed thickness, pulling up the press die 5, then raising the elevating base 64, allowing the upright pillars 76 on the elevating base 64 to enter the holes in the bottom of the cavity 3' upwardly, thereby lifting the bottom plate 77 and the molded concrete product carried thereon from the upper side of the pattern frame 3, transferring the concrete product onto the loading bed of a forklift, and carrying it out of the frame 11. In preparation for the next round of molding, the elevating base 64 is lowered to separate the pillars 76 downwardly from the bottom of the cavity 3', another bottom plate 77 is laid inside the cavity 3', and the procedure described above is repeated. During the supply of the concrete material and during the release of the molded concrete product from the pattern frame 3, the pattern frame 3 is kept vibrated with the vibrators 60 disposed on the front and rear sides of the pattern frame 3. During the course of the molding of concrete product, the concrete material in the cavity 3' is kept vibrated with the aforementioned vibrators 60 and the vibrators 13 of the press 4.

What can be generally said about all the embodiments cited above is the fact that so long as the height from the lower side of the pattern frame 3 or the engaging part to the upper side of the base plate 6 of the press die 5 assembled on the pattern frame 3 is constant ("H" in FIG. 1) in spite of the difference in thickness or height of the pattern frame 3 due to the variation in thickness of concrete products, the descent of the press 4 to be made for the purpose of assembling the press die 5 on the pattern frame 3, transferring the press die 5 and the pattern frame 3 in the assembled state into the frame 11, and joining the press die 5 to the lower side of the press 4 or for the purpose of assembling the press die 5 on the pattern frame 3 within the frame 11 in preparation for a change of the pattern frame 3 and the press die 5 can be made with a fixed stroke and, consequently, the operational efficiency is notably high as compared with the descent made with a random stroke.

When the thickness of the pattern frame 3 is varied by the thickness of the concrete products as in the pattern frame 3 of the first and second embodiments, the stroke of the descent of the press 4 can be standardized by increasing the downward length of the pins 6' in proportion to the decrease in thickness of the pattern frame 3 as in the case of the pattern frame 3 on the means of conveyance 18 illustrated in FIG. 1. In the case of the pattern frame 3 whose cavity 3' has a bottom and whose upper side falls flush with the deck 15 as in the third, fourth, and fifth embodiments, the standardization of the stroke of the descent is attained by fixing the height from the lower side of the pattern frame 3 to the upper side of the pattern frame 3 and also fixing the length of the pins 6' without reference to the thickness of the concrete products being molded.

In the manufacture of concrete products of fixed shape and varying thickness, although the cavity 3' of the pattern frame and the press die 5 share an identical shape, a plurality of pattern frames varying in the thickness of the pattern frame 3 and the depth of cavity 3' and as many press dies varying in thickness may be prepared to be properly selected and used. Otherwise, one press die 5 is always kept joined to the press 4 and a plurality of pattern frames of varying thickness are changed one for another whenever the thickness of the concrete products being molded is changed. This idea of the combination of one press die 5 and a plurality of pattern frames is also embraced by the present invention.

Figure 21:
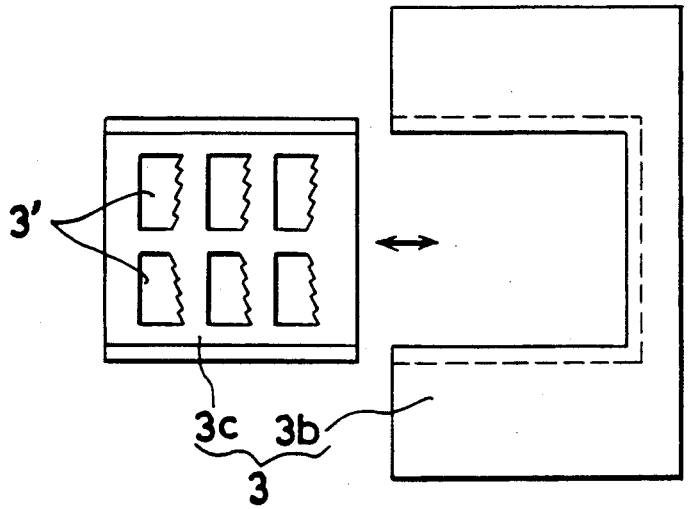
FIG. 21 is a plan view of a pattern frame for use in the molding machine.
Figure 22:
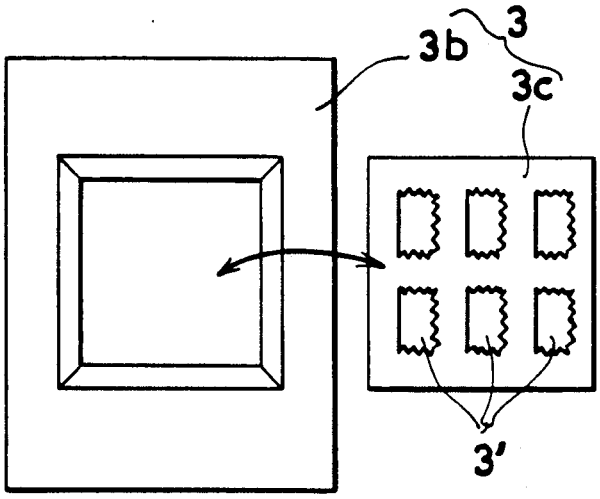
FIG. 22 is a plan view of another pattern frame for use in the molding machine.

The pattern frame 3 is not limited to the type which has the cavity 3' integrally formed therein. It may be formed of a U-shaped outer pattern frame 3*b* and an inner pattern frame 3*c* containing a cavity 3' and fixed within the aforementioned outer pattern frame 3*b* as illustrated in FIG. 21. Optionally, the outer pattern frame 3*b* may be formed as a conical shape as illustrated in FIG. 22. In either case, the engaging parts 31 to be inserted between the pair of rails 30 used as the retaining means and disposed within the molding region is formed on the outer pattern frame 3*b*.

It is optional that another set of a hopper 1 and a material supply box 2 is additionally provided as indicated by the broken line in FIG. 2 and FIG. 3 and one of the two hoppers 1 is filled with ordinary concrete material to be used in forming the greater part of the whole thickness of a concrete product and the other hopper with concrete material containing a coloring matter or other ornamental material and used in forming the remaining part of the thickness of the concrete product. In this arrangement, a stated amount of the concrete material held in either of the hoppers 1 is transported in the material supply box 2 and poured into the cavity 3' and compressed therein with the press die 5 and, thereafter, a fixed amount of the concrete material in the other hopper 1 is similarly transported by the material supply box 2 and poured into the same cavity 3' and compressed by the same press die 5 to give rise to a concrete product of a prescribed thickness.

In accordance with this invention, the pattern frame 3 and the press die 5 can be changed and set in place very quickly with minimal labor. This invention enjoys an epochal feature of enabling concrete products varied in both shape and thickness or varied only in thickness to be manufactured at no sacrifice of production efficiency.

Obviously, many modifications and variations of the present invention are possible in light of the above teachings. It is therefore to be understood that within the scope of the appended claims, the present invention may be practiced otherwise than as specifically described herein.

What is claimed is:

1. A method for setting a pattern frame and a press die within a molding machine, comprising the steps of:

providing a molding region within said molding machine;

providing a pattern frame having a mold cavity defined therein;

providing pattern frame retaining means within said molding region of said molding machine for retaining said pattern frame within said molding region of said molding machine;

providing a hopper means for holding concrete material to be molded within said mold cavity of said pattern frame;

providing a reciprocating material supply box movable between said hopper means and said mold cavity of said pattern frame so as to supply said concrete material from said hopper means to said mold cavity of said pattern frame retained within said molding region of said molding machine;

providing a reciprocating press within said molding region of said molding machine;

providing a press die to be mounted upon said reciprocating press so as to compress said concrete material to be molded within said mold cavity of said pattern frame;

providing first attachment means upon said reciprocating press, and second attachment means upon said press die, for mating with each other so as to secure said press die upon said reciprocating press;

mating said press die within said pattern frame at a position outside of said molding region;

transferring said mated press die and said pattern frame as a modular unit from said position outside of said molding region and into said molding region so as to cause engagement of said pattern frame with said pattern frame retaining means as said press die-pattern frame modular unit is transferred from said position outside of said molding region and into said molding region whereby said pattern frame will be retained within said molding region by said pattern frame retaining means; and causing relative movement between said press die and said reciprocating press so as to mate said first and second attachment means of said reciprocating press and said press die whereby said press die will be secured upon said reciprocating press.

2. A method as set forth in claim 1, further comprising the steps of:

vibrating said press die by a first vibrating means disposed upon said press; and vibrating said pattern frame by second vibrating means disposed within said molding region of said molding machine and in contact with said pattern frame retained within said molding region of said molding machine.

3. A method as set forth in claim 1, further comprising the step of:

removing a molded product from said molding region of said molding machine.

4. A method as set forth in claim 3, wherein:

said reciprocating press is movable in a first direction within said molding region of said molding machine; and said molded product is removed from said molding region of said molding machine in a rectilinear manner in a second direction transverse to said first direction of movement of said reciprocating press.

5. A method as set forth in claim 3, wherein:

said reciprocating press is movable in a first direction within said molding region of said molding machine; and said molded product is removed from said molding region of said molding machine in a rotary-inversion manner by rotating and inverting said pattern frame about an axis disposed along a second direction transverse to said first direction of movement of said reciprocating press.

6. Apparatus for setting a pattern frame and a press die within a molding machine, said apparatus comprising:

means defining a molding region within said molding machine;

a pattern frame defining a mold cavity therein;

pattern frame retaining means disposed within said molding region of said molding machine for retaining said pattern frame within said molding region of said molding machine;

means defined upon said pattern frame for engaging said pattern frame retaining means whereby said pattern frame is retained within said molding region of said molding machine;

hopper means for holding concrete material to be molded within said mold cavity of said pattern frame;

a reciprocating material supply box movable between said hopper means and said mold cavity of said pattern frame for supplying said concrete material from said hopper to said mold cavity of said pattern frame;

a reciprocating press disposed within said molding region of said molding machine;

a press die to be mounted upon said reciprocating press so as to compress said concrete material to be molded within said mold cavity of said pattern frame;

first attachment means mounted upon said reciprocating press, and second attachment means mounted upon said press die, for mating engagement with each other so as to secure said press die upon said press;

means for transferring said press die and said pattern frame as a modular unit from a position outside of said molding region into said molding region so as to cause engagement of said pattern frame engaging means with said pattern frame retaining means as said press die-pattern frame modular unit is transferred from said position outside of said molding region and into said molding region whereby said pattern frame will be retained within said molding region by said pattern frame retaining means; and means for causing relative movement between said press and said press die so as to cause said mating engagement of said first and second attachment means of said reciprocating press and said press die, respectively.

7. An apparatus according to claim 6, wherein said means for transferring said press die and said pattern frame into said molding region is a roller conveyor.

8. An apparatus according to claim 6, wherein said means for retaining said pattern frame within said molding region comprises a pair of rails laid inside said molding region and said pattern frame engaging means comprises a pair of engaging parts disposed on the bottom of said pattern frame and adapted to fit into said rails.

9. An apparatus according to claim 6, wherein said second attachment means of said press die comprises a pair of projected pieces containing an opening and disposed on the upper side of said press die and said first attachment means comprises a pair of wedges disposed on said press and adapted to fit into said openings and move in opposite directions; and means for moving said wedges in opposite directions for engaging said projected pieces through said openings.

10. Apparatus as set forth in claim 9, wherein:

said means for moving said wedges in said opposite directions comprises rotary turnbuckle means, having righthand and lefthand threaded shaft portions, for respective engagement with said wedges.

11. An apparatus according to claim 6, wherein:

said first means for attachment of said press die is an electromagnetic plate disposed on said press; and said second means for attachment of said press die is a base plate mounted upon said press die for attraction to said electromagnetic plate.

12. An apparatus according to claim 6, wherein:

said second attachment means of said press die comprises a conical wedge disposed upon the upper side of said press die, and said first attachment means comprises a tapered hole formed within said reciprocating press and adapted to permit said wedge to be disposed therein; and means for securing said conical wedge of said press die within said tapered hole of said reciprocating press.

13. Apparatus as set forth in claim 12, wherein said securing means comprises:

a recess defined within a sidewall portion of said conical wedge;

a projecting piece slidably mounted upon said reciprocating press for movement into and out of said recess of said conical wedge; and two-way reciprocating piston-cylinder means operatively connected to said projecting piece for moving said projecting piece into and out of said recess of said conical wedge.

14. Apparatus as set forth in claim 12, wherein said securing means comprises:

a recess defined within a sidewall portion of said conical wedge;

a projecting piece slidably mounted upon said reciprocating press for movement into and out of said recess of said conical wedge;

spring means mounted upon said reciprocating press and operatively connected to said projecting piece for biasing said projecting piece in a first direction such that said projecting piece is disposed within said recess of said conical wedge; and solenoid means mounted upon said reciprocating press for engaging said projecting piece so as to move said projecting piece in a second direction, opposite to said first direction, against the biasing force of said spring means in order to move said projecting piece out of said recess of said conical wedge.

15. Apparatus as set forth in claim 6, additionally comprising:

first vibrating means disposed upon said press for vibrating said press die; and second vibrating means disposed within said molding region in contact with said pattern frame for vibrating said pattern frame within said molding region.

16. Apparatus as set forth in claim 6, further comprising:

means for discharging molded products from said molding region to a position outside of said molding region.

17. Apparatus as set forth in claim 6, wherein:

said first attachment means comprises a nut and wormworm wheel drive means for driving said nut; and said second attachment means comprises upstanding bolt means for engagement with said nut.

18. Apparatus as set forth in claim 16, wherein:

said discharging means comprises rotary-inversion means for rotationally inverting said pattern frame so as to rotationally invert said molded product for discharge out of said mold cavity of said pattern frame.

19. Apparatus as set forth in claim 6, wherein:

said pattern frame is comprised of mated sections.

20. A method as set forth in claim 1, further comprising the step of:

causing relative movement between said reciprocating press, with said press die secured upon said reciprocating press, and said pattern frame retaining means, with said pattern frame engagingly retained upon said pattern frame retaining means, so as to separate said press die from said pattern frame subsequent to said securement of said press die upon said reciprocating press and thereby lockingly secure said pattern frame upon said pattern frame retaining means.

* * * * *